US006035950A

United States Patent [19]

Heller et al.

[11] Patent Number: 6,035,950

[45] **Date of Patent: *Mar. 14, 2000**

[54] METHOD AND APPARATUS FOR FLUID AND SOIL SAMPLING

[75] Inventors: Noah Heller, Mill Valley; Jeffrey Barrow, Woodland; Jeffrey Gamble, Yuba City, all of Calif.

[73] Assignee: SimulProbe Technologies, Inc., Mill Valley, Calif.

[ * ] Notice: This patent is subject to a terminal disclaimer.

[21] Appl. No.: 09/067,998

[22] Filed: Apr. 28, 1998

Related U.S. Application Data

[63] Continuation of application No. 08/403,371, Mar. 15, 1995, Pat. No. 5,743,343, which is a continuation-in-part of application No. 08/124,789, Sep. 21, 1993, Pat. No. 5,421,419.

[51] Int. Cl.[7] ..... E21B 49/02

[52] U.S. Cl. ..... 175/20; 175/58; 175/405

[58] Field of Search ..... 175/58, 59, 20, 175/23, 244, 249, 320, 403, 405

[56] References Cited

U.S. PATENT DOCUMENTS

| | | | |
|---|---|---|---|
| 763,212 | 6/1904 | Shuman | 175/23 |
| 1,737,256 | 11/1929 | McQuiston | 175/58 |
| 1,896,703 | 2/1933 | Dean | 175/249 |
| 2,167,991 | 8/1939 | Oliver | 175/404 |
| 2,283,650 | 5/1942 | Sanborn | 175/20 |
| 2,313,576 | 3/1943 | Phillips et al. | 175/249 |
| 2,382,992 | 8/1945 | Harris | 175/20 |
| 2,664,269 | 12/1953 | Knight et al. | 175/20 |
| 2,751,010 | 6/1956 | Trahn | 175/249 |
| 3,016,096 | 1/1962 | Spalding | 166/332 |
| 3,047,081 | 7/1962 | Pitcher | 175/239 |
| 3,064,742 | 11/1962 | Bridwell | 175/59 |
| 3,151,681 | 10/1964 | Cochran | 166/332 |
| 3,318,394 | 5/1967 | Gleason et al. | 175/5 |
| 3,367,188 | 2/1968 | Robinson | 175/20 |
| 3,412,814 | 11/1968 | Rosfelder | 175/6 |
| 3,447,615 | 6/1969 | Schick | 175/17 |
| 3,685,345 | 8/1972 | Wise | 73/19 |
| 3,794,127 | 2/1974 | Davis | 73/19 |
| 3,805,900 | 4/1974 | Sainsbury | 175/249 |
| 4,098,360 | 7/1978 | Clements | 175/313 |
| 4,317,490 | 3/1982 | Milberger et al. | 175/20 |
| 4,335,622 | 6/1982 | Bartz | 73/864.74 |
| 4,452,091 | 6/1984 | Richers | 73/864.52 |
| 4,518,050 | 5/1985 | Sollie et al. | 175/250 |
| 4,518,051 | 5/1985 | Sollie et al. | 175/250 |
| 4,588,036 | 5/1986 | Desrochers et al. | 175/58 |
| 4,669,554 | 6/1987 | Cordry | 175/59 |
| 4,729,437 | 3/1988 | Zapico | 175/20 |
| 4,809,790 | 3/1989 | Manchak, Jr. | 175/17 |
| 4,953,637 | 9/1990 | Starr et al. | 175/20 |
| 5,046,568 | 9/1991 | Cordry | 175/21 |
| 5,146,998 | 9/1992 | Cordry et al. | 175/21 |
| 5,186,263 | 2/1993 | Keir et al. | 175/20 |
| 5,211,249 | 5/1993 | Richter et al. | 175/20 |

FOREIGN PATENT DOCUMENTS

| | | | |
|---|---|---|---|
| 896253 | 2/1945 | France | 175/58 |
| 713982 | 2/1980 | Russian Federation | 175/244 |
| 1177444 | 9/1985 | Russian Federation | 175/59 |

OTHER PUBLICATIONS

Gillham, et al. "A Device for In Situ Determination of Geochemical Transport Parameters 1. Retardation"; Ground Water; vol. 28, No. 5; Sep.–Oct. 1990; pp. 666–672.

Gillham, et al. "A Device for In Situ Determination of Geochemical Transport Parameters 2. Biochemical Reactions" Ground Water; vol. 28, No. 6; Nov.–Dec. 1990; pp. 858–862.

*Primary Examiner*—Hoang Dang
*Attorney, Agent, or Firm*—Limbach & Limbach

[57] ABSTRACT

A sampling device includes a barrel having a downhole end, an exterior surface, an interior surface defining a hollow interior, and an open end at the downhole end of the hollow interior. A fluid entrance penetrates the exterior surface. A fluid path having an outlet port is fluidly coupled to the fluid entrance. The device is driven into a subsurface so that a soil sample is forced into the hollow interior. While the device is still in the subsurface a fluid sample is collected through the least one fluid entrance and fluid path.

9 Claims, 17 Drawing Sheets

METHOD AND APPARATUS FOR FLUID AND SOIL SAMPLING

CROSS-REFERENCE TO RELATED APPLICATION

This is a continuation of application Ser. No. 08/403,371, filed Mar. 15, 1995 now U.S. Pat. No. 5,743,343 which is a CIP of application Ser. No. 08/124,789, filed Sep. 21, 1993, now U.S. Pat. No. 5,421,419.

BACKGROUND OF THE INVENTION

The present invention relates to the field of fluid and soil sampling methods and apparatus. Modern industries produce contaminants which are often released onto land. The contaminants migrate downward into the subsurface creating potential health risks. Contaminant remediation plans are implemented to remove soil and ground water contamination.

Designing a remediation plan typically requires collecting soil and fluid samples to determine the extent of subsurface contamination. The term fluid as used herein refers to both gas and liquid. Soil samples provide subsurface data including contaminant concentration for inorganic and organic compounds, grain size, mineral composition, texture, density, permeability and porosity. Fluid samples are analyzed to determine contaminant concentration, organic chemistry in the case of soil gas, and both organic and inorganic chemistry in the case of liquid.

A conventional method of collecting soil and soil gas samples is to drill a borehole to a desired sampling depth and lower a soil sampling device into the bottom of the borehole. Soil sampling devices typically have a hollow interior and are driven into the formation by repetitive percussion. As the device is driven into the formation a soil sample is forced into the hollow interior. The sampling device is removed from the borehole to retrieve the soil sample. A soil gas probe is then lowered into the borehole and driven into the formation to collect a gas sample.

A problem with the conventional method of collecting soil and soil gas samples is that during the time between retrieval of the soil sampling device and lowering of the soil gas probe, the gas in the subsurface immediately below the bottom of the borehole may be released into the borehole atmosphere before it can be collected by the soil gas probe. Off-gassing results from decreased lithostatic load due to removal of soil in the borehole. The off-gassing into the borehole will likely reduce the soil gas concentration readings.

A further problem with the known method is that the soil and soil gas samples are not collected from the same depth. When constructing a contaminant distribution model it is highly desirable to have both soil and fluid samples from the same depth for direct correlation between various soil and fluid data.

A second conventional method for extracting soil and gas samples from the same depth is to first drive the soil gas probe into the bottom of the borehole and collect a soil gas sample. The soil gas probe is then removed from the borehole and a soil sampling device is lowered into the borehole. The soil sampling device is driven around the hole produced by the soil gas probe. The soil sampler is then removed from the borehole to recover the sample. The soil sample will include a cylindrical depression formed by the soil gas probe.

A problem with the second conventional method of collecting soil and soil gas samples from the same depth is that the soil sample is manifestly disturbed by the collapsed hole made by the gas probe. The collapsed hole adversely affects various measurements, such as permeability, porosity and texture. The soil sample may also be chemically biased by off-gassing during soil gas sample collection. Off-gassing may affect, for example, the amount of volatile organics in the soil sample.

Conventional fluid and soil sampling devices collect either soil or fluid samples. Before each device is lowered into the borehole the device is decontaminated so that the sampling is not tainted. A problem with conventional fluid and soil sampling devices is that each device must be decontaminated, lowered into the borehole, and removed from the borehole to collect each individual sample. The increased operating time necessary to extract both soil and fluid samples increases the cost of extracting the samples.

Another method of retrieving a soil sample is the direct push method which is described in U.S. Pat. No. 5,186,263 to Kejr et al., which is herein incorporated by reference. In the direct push method, the sampling device includes a releasable tip so that the sampling device may be driven into the subsurface to the desired sampling depth. The tip is initially rigidly coupled to the sampling device to permit direct drive of the sampling device into the subsurface. Once the sampling device is at the desired sampling depth, the tip is released to permit a soil sample to enter the sample chamber. As disclosed in U.S. Pat. No. 5,186,263, the tip is coupled to a rod system which is used to lock and release the tip. When driving the sampling device of U.S. Pat. No. 5,186,263 into the ground, rods must be added to the device to achieve the desired sampling depth.

A problem with U.S. Pat. No. 5,186,263 is the time it takes to add each rod during driving of the sampling device to the desired sampling depth. The amount of time it takes to add successive rods increases the amount of time required to obtain soil samples and, therefore, increases the cost of obtaining soil samples.

SUMMARY OF THE INVENTION

The problems associated with prior art fluid and soil sampling methods and apparatus are overcome in accordance with the method and apparatus of the present invention. An environmental sampling device includes a barrel having a downhole end, an exterior surface, an interior surface defining a hollow interior, and an open end at the downhole end of the hollow interior. A fluid entrance penetrates the exterior surface and a fluid path is fluidly coupled to the fluid entrance and positioned between the interior and exterior surfaces.

The downhole end of the sampling device is driven into a subsurface so that a soil sample of the subsurface is forced through the open end and into the hollow interior. While the sampling device is in the subsurface a fluid sample is collected from the subsurface through the fluid entrance and the fluid path.

The sampling device preferably includes a mechanism for preventing a fluid flow through the fluid entrance until after the driving step has been initiated. A preferred fluid flow preventing mechanism is a drive shoe which is movably mounted to the barrel between a first position, in which the drive shoe covers the fluid entrance, and a second position, in which the drive shoe is spaced apart from the fluid entrance. The drive shoe is moved to the second position by pulling the sampling device toward an uphole end before the collecting step. As the sampling device is pulled toward the uphole end the drive shoe frictionally engages the formation and moves to the second position. The fluid flow preventing mechanism may also be an elastic band sized to fit around the barrel and positioned to cover the fluid entrance.

The hollow interior preferably has a substantially cylindrical shape and an inner diameter in a range of about 1 to 6 inches. The fluid path preferably includes an annular channel housed between the interior and exterior surfaces and fluidly coupled to the fluid entrance.

The barrel preferably includes a drive shoe rigidly attached to the downhole end of the barrel. The drive shoe has an angular cutting edge defining the open end. The drive shoe defines a portion of the exterior surface of the barrel. The fluid entrance preferably penetrates the portion of the exterior surface at the drive shoe.

The sampling device also preferably includes a valve assembly rigidly attached to the barrel at an uphole end. The valve assembly houses a displaced air line having an exhaust port and an entrance port. The displaced air line provides an exhaust path for air displaced in the hollow interior by the soil sample. A check valve is positioned along the displaced air line between the entrance port and the exhaust port which permits flow only from the entrance port to the exhaust port.

In another aspect of the present invention, the sampling device includes a releasable tip which is operably coupled to the movable drive shoe. The sampling device is first driven to the desired depth with the tip locked to the remainder of the sampling device. Once the desired sampling depth is achieved, the tip is released, preferably by pulling on the device. The sampling device is then driven into the subsurface so that a soil sample enters a sample barrel. As the soil sample enters the sample barrel, the soil sample displaces the tip into the sample barrel.

An advantage of the releasable tip of the present invention is that the releasing mechanism does not require rods as is used in conventional direct push sampling devices. By eliminating the rods, the amount of time it takes to reach the sampling depth is reduced thereby reducing the overall cost of obtaining the soil sample.

Other features and advantages of the invention will appear from the following description in which the preferred embodiments have been set forth in detail in conjunction with the accompanying drawings.

DESCRIPTION OF THE PREFERRED EMBODIMENTS

Figure 1:
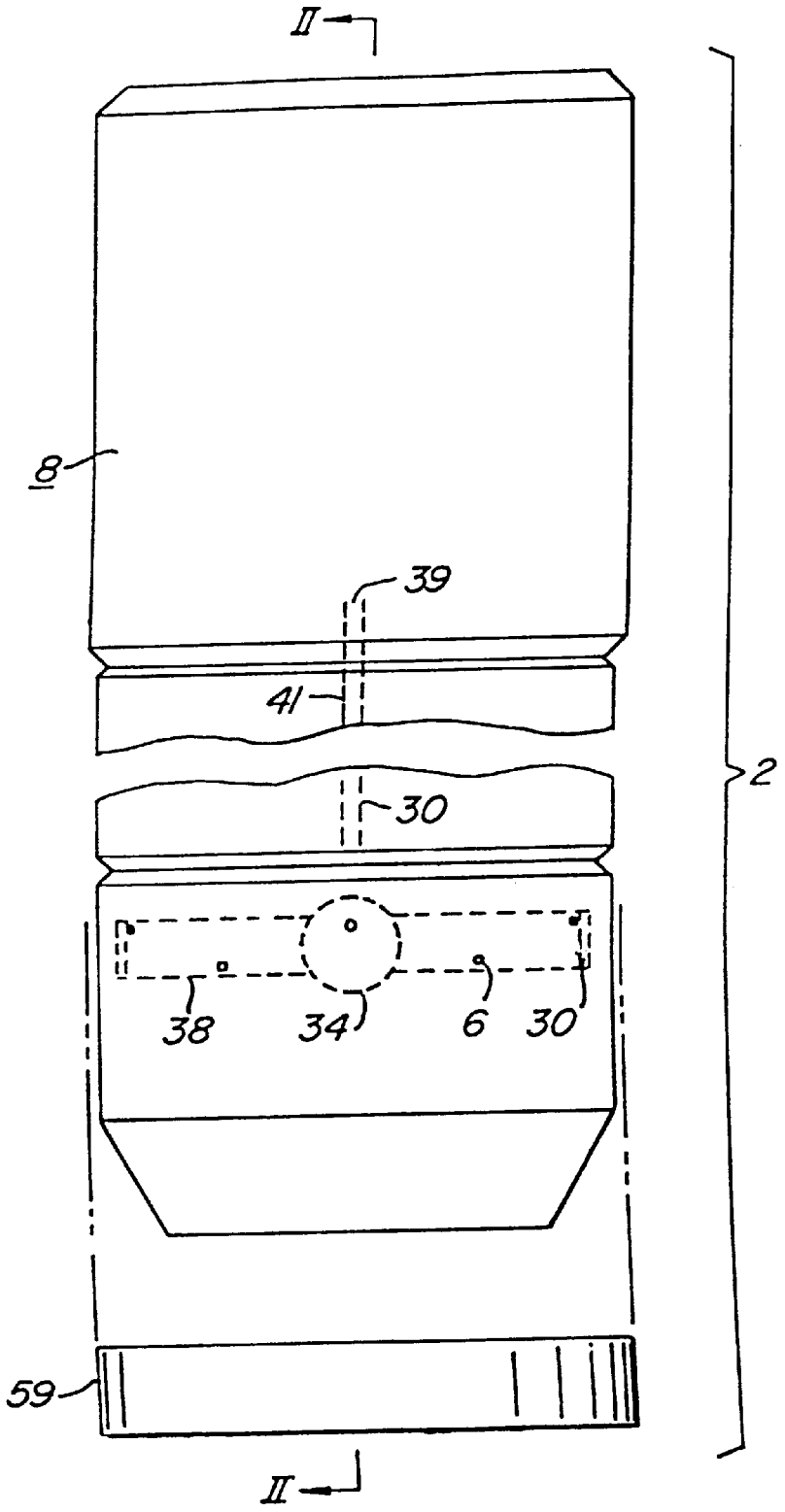
FIG. 1 is a side view of a soil and fluid sampling device.
Figure 2:
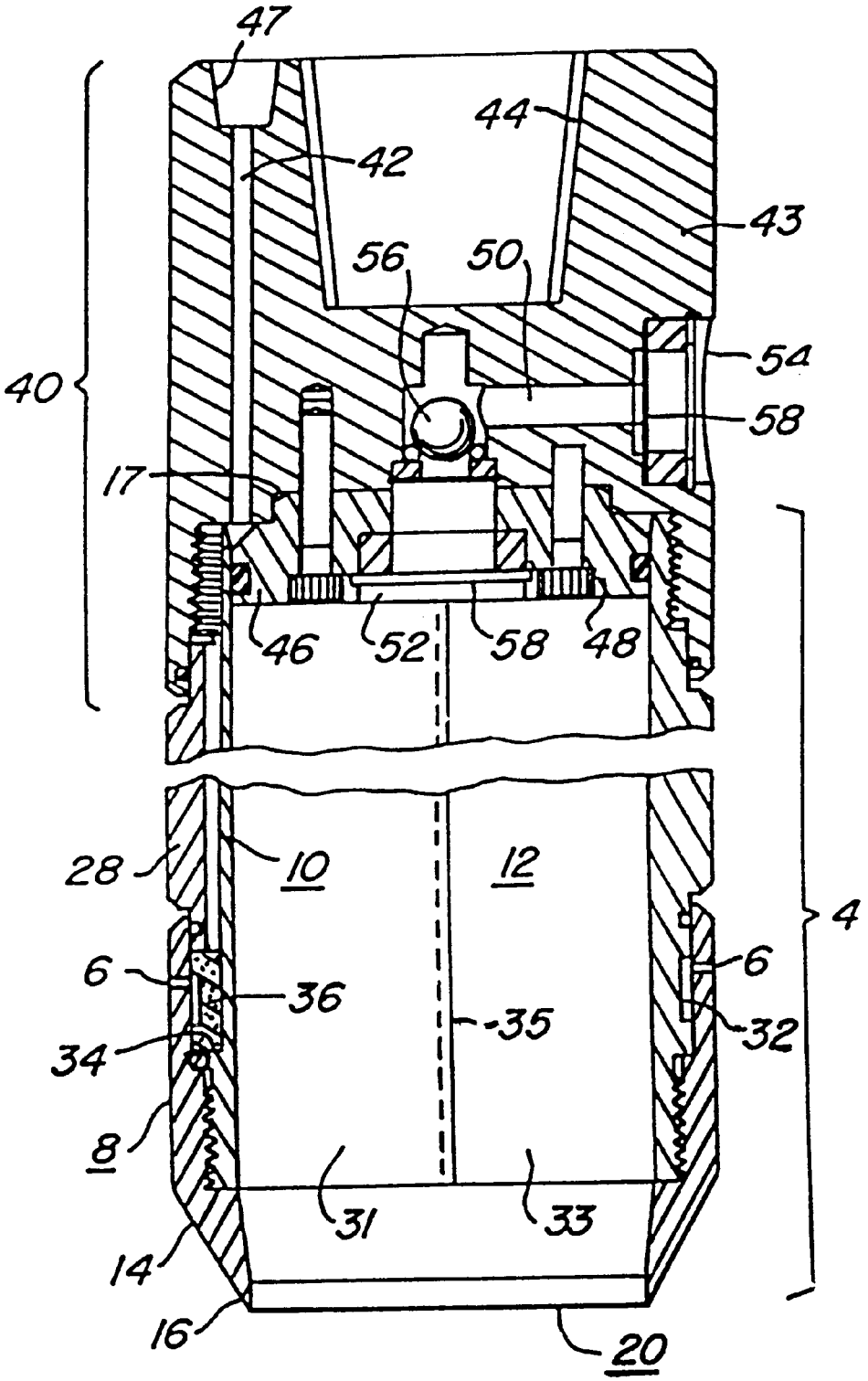
FIG. 2 is a cross-sectional view of the sampling device of FIG. 1 along line II—II.

A sampling device 2 for collecting a soil and a fluid sample includes a barrel 4 having an exterior surface 8 and an interior surface 10 (FIGS. 1 and 2). The exterior and interior surfaces 8, 10 may take any shape but are preferably generally cylindrical. A fluid entrance 6 penetrates the exterior surface 8 and is used to collect a fluid sample as described below.

The interior surface 10 of the barrel 4 defines a hollow interior 12. A soil sample is collected by driving the sampling device 2 into a subsurface so that the soil sample is forced into the hollow interior 12 of the barrel 4. The sampling device 2 is preferably driven into the subsurface by a wire line driven drive hammer or rod driven drive hammer (not shown). The sampling device 2 may also be driven into the formation by any other conventional method, such as rotary drilling.

Figure 5:
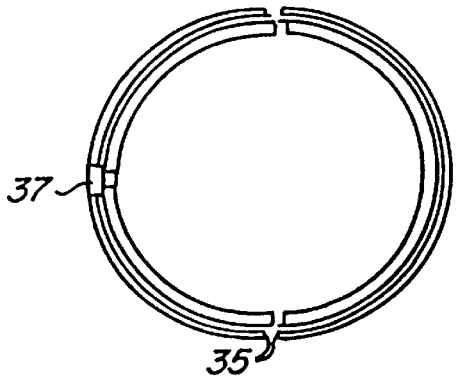
FIG. 5 is cross-sectional view of the sample tube of FIG. 3 along line V—V.
Figure 6:
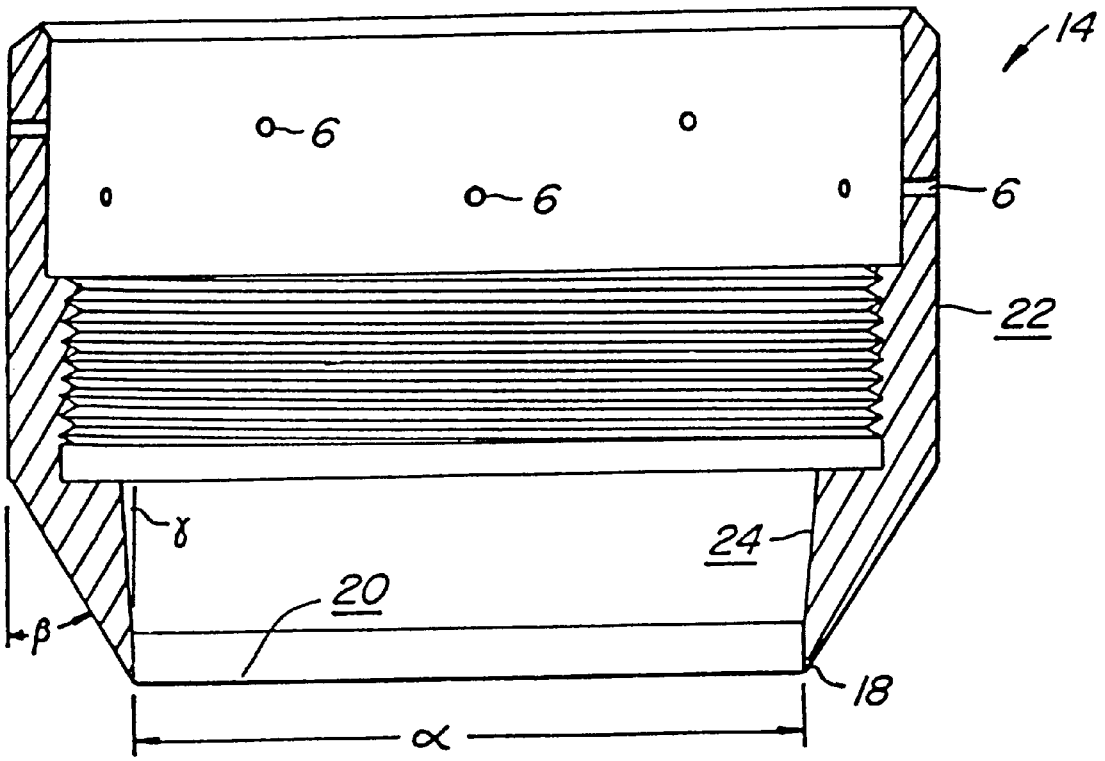
FIG. 6 is a cross-sectional view of a drive shoe.

The barrel 4 includes a sample tube 28 and a drive shoe 14 (FIG. 6) connected to the sample tube at a downhole end 16. The drive shoe 14 and sample tube 28 are preferably formed separately but may also be formed in one piece. The sample tube 28 is preferably split longitudinally along a split line 35 into first and second sections 31, 33 (FIGS. 5 and 6). The inner diameter of the sample tube is preferably in a range from about ½ to 6 inches, most preferably in a range of 1 to 4 inches and most preferably about 2½ inches when the hollow interior has a circular cross-section. If the hollow interior has any other cross-sectional shape, the area of the cross-sectional shape is preferably in a range of 0.79 to 113.10 square inches and most preferably in a range of 3.14 to 50.27 square inches. The first and second sections 31, 33 are secured together at the downhole end by the drive shoe 14 and at an uphole end 17 by a valve assembly 40. The valve assembly 40 includes an outer body 43 and an inner body 46 attached to the outer body 43 with bolts 48.

The drive shoe 14 has an angular cutting edge 18 for piercing the subsurface (FIG. 6). The angular cutting edge 18 defines an open end 20 leading to the hollow interior 12. The open end 20 preferably has a diameter $\alpha$ of about 2.375 inches but may range from about 1 inch to about 4 inches. The angular cutting edge 18 has an angle $\beta$ oriented about 30° from the outer surface 22 of the drive shoe (FIG. 6). An inner surface 24 of the drive shoe is oriented at an angle $\gamma$ which is about 3° with respect to a vertical axis 26 of the drive shoe. The drive shoe is preferably made of heat treated SAE 4140 steel. The preceding dimensions are preferred, however, any other drive shoe configuration may also be used.

Figure 8:
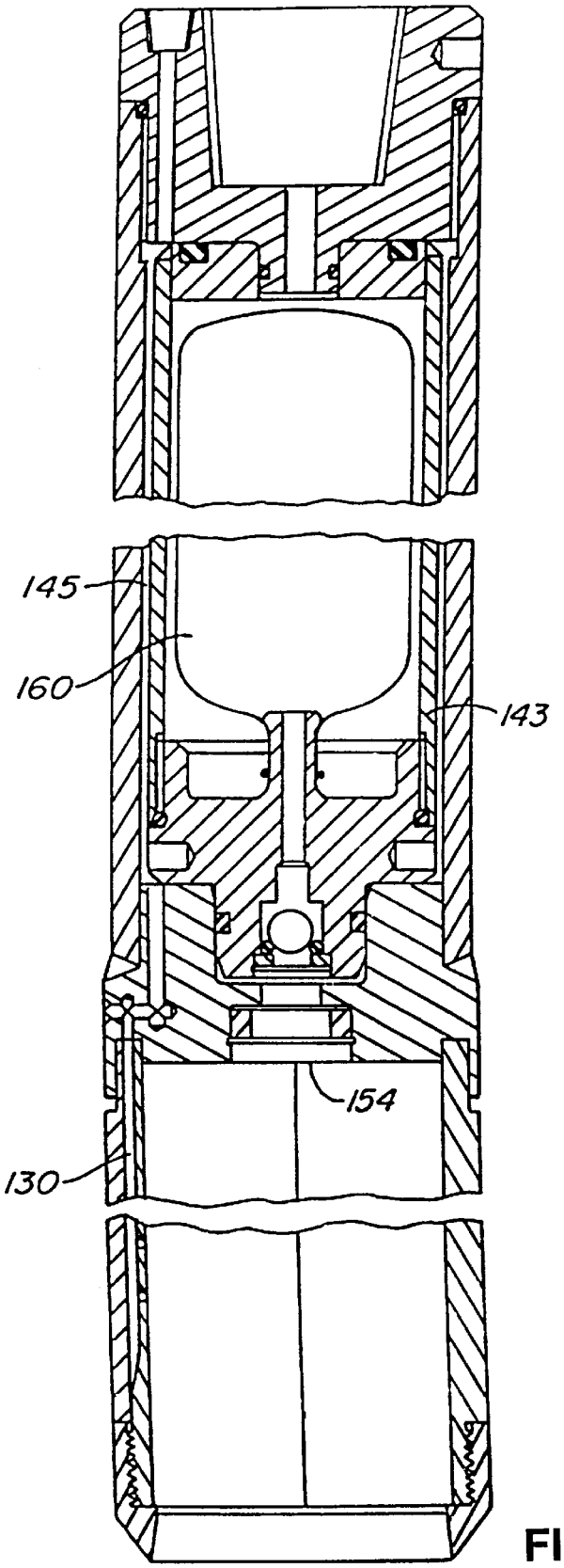
FIG. 8 is a cross-sectional view of the sampling device of FIG. 7 with the fluid entrances penetrating the interior surface of the barrel.

The sampling device preferably includes a plurality of fluid entrances 6 which penetrate the exterior surface 8 of the barrel 4. The fluid entrances 6 have a diameter of about 0.0062 inches and are configured in two rows of six fluid entrances circumferentially spaced around the barrel 4. The fluid entrances 6 are preferably positioned at the downhole end 16 but may be positioned anywhere along the barrel. The fluid entrance 6 may take many forms and shapes. For example, the fluid entrance may be a single slot circumscribing a substantial portion of the circumference, a large number of perforations, vertically disposed slots, or any combination thereof. The fluid entrance 6 preferably penetrates only the exterior surface 10 so that the soil sample within the hollow interior 12 is not chemically biased during collection of the fluid sample. The fluid entrance may, however, also penetrate the interior surface of the barrel (FIG. 8).

The fluid entrance 6 is fluidly coupled to an annular channel 32 formed between the drive shoe 14 and the sample tube 28. The annular channel 32 includes an enlarged filter cavity 34 which houses a filter 36. The filter cavity 34 has a generally larger cross-sectional flow area than the annular channel 32 to minimize flow resistance at the filter.

Figure 3:
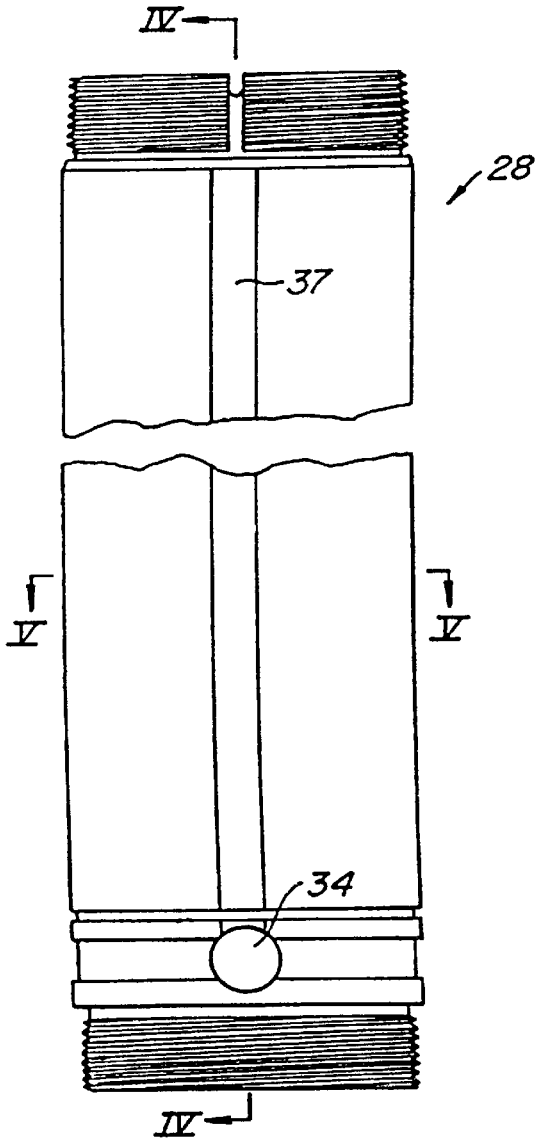
FIG. 3 is a side view of a sample tube.
Figure 4:
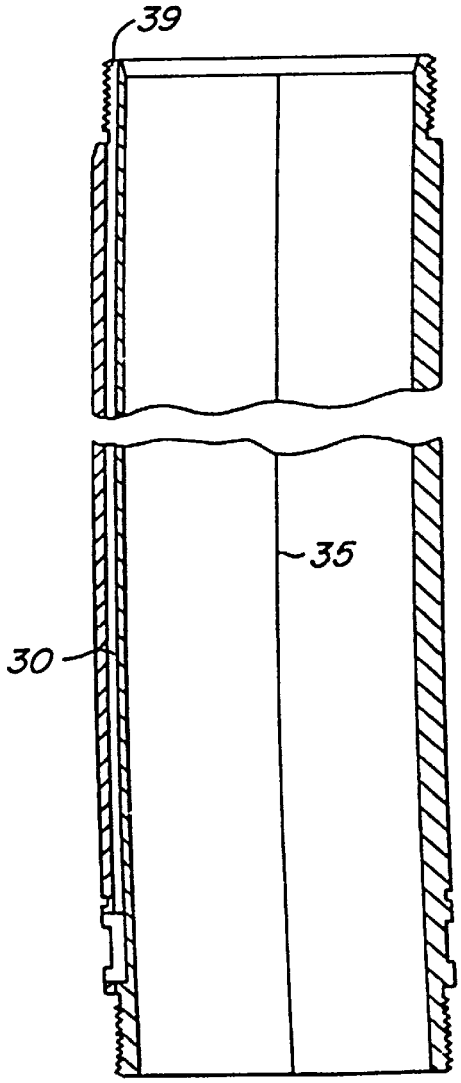
FIG. 4 is a cross-sectional view of the sample tube of FIG. 3 along line IV—IV.

The annular channel 32 is fluidly coupled to a longitudinal channel 30 at the filter cavity 34. The longitudinal channel 30 terminates at an outlet port 39 (FIGS. 2 and 3). The preferred embodiment includes a single channel 30, however, a number of channels may also be used. The channel 30 is formed by cutting a longitudinally T-shaped section into the barrel (FIG. 5). An outer piece 37 is then seal welded into the upper part of the T-shaped section thereby forming the channel 30 between the outer piece 37 and the sample tube 28. A stainless steel tube (not shown) may be brazed into the longitudinal channel 30 to facilitate cleaning and resist corrosion.

The annular channel 32, filter cavity 34, and channel 30 together define the fluid path 38 which is depicted by broken lines 41 in FIG. 1. The fluid path 38 terminates at the outlet port 39 of the barrel 4 (FIG. 2). The fluid path 38 may take many forms so long as it fluidly couples the fluid entrance 6 and the outlet port 39.

The valve assembly 40 is rigidly attached to an upper end of the sample tube 28 by a threaded connection or slip coupling. The valve assembly 40 includes a fluid sample path 42 coupled to the outlet port 39 of the sample tube (FIG. 2). The fluid sample path 42 terminates at an outlet connection 47. The outlet connection may be coupled to a vacuum pump (not shown) for extracting a soil gas sample. The outer body 43 of the valve assembly 40 also includes a threaded rod connection 44 (FIG. 2) for receiving a rod used to drive the sampling device 2 into the subsurface.

The valve assembly 40 houses a displaced air line 50 having an entrance port 52 and an exit port 54. The entrance port 52 opens into the hollow interior 12. A check valve 56, preferably a ball valve, is positioned along the displaced air line 50 between the entrance and exit ports. When the soil sample enters the hollow interior the air displaced by the soil sample is exhausted through the displaced air line 50. The entrance and exit ports 54 also include screens 58 which prevent particulate matter from entering the displaced air line 50. The screens 58 are preferably stainless steel mesh cloth.

A flow preventing mechanism prevents flow into the fluid entrance 6 before the barrel 4 is driven into the subsurface. The flow preventing mechanism ensures that cross-contamination of the fluid sample does not occur. A preferred flow preventing mechanism is an elastic band 59 sized to fit around the exterior surface of the barrel and positioned to cover the fluid entrance 6 (FIG. 1). As the barrel is driven into the subsurface, frictional engagement between the elastic band 59 and the subsurface displaces the elastic band toward the uphole end 17 thereby exposing the fluid entrance 6. The flow preventing mechanism may take many forms such as a flow prevention valve along the fluid path 38. A further flow preventing mechanism is described below in connection with FIGS. 9–13.

Figure 7:
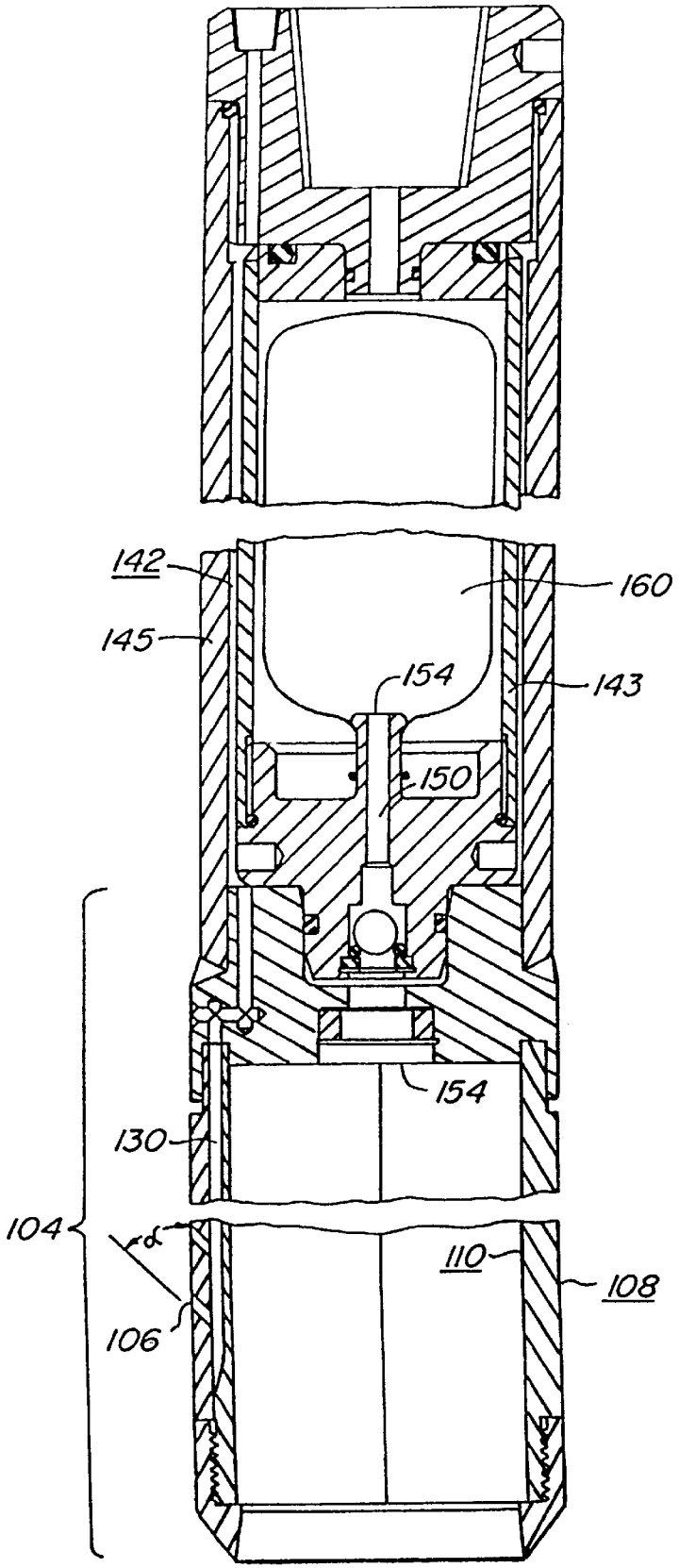
FIG. 7 is a cross-sectional view of a second embodiment of the soil and fluid sampling device.

A second embodiment of the invention is shown in FIG. 7. A sampling device 102 includes a plurality of fluid entrances 106 extending along the length of a longitudinal channel 130 and spaced at one inch intervals. The fluid entrance 106 has a diameter of 0.0062 inches and are at an angle $\delta$ of about 45° with respect to the exterior surface 108. The fluid entrance 106 may, of course, take any shape, size and angular orientation.

The longitudinal channel 130 is fluidly coupled to an annular path 142 defined between an outer wall 145 and an outer body 143. The outer body 143 houses a gas bladder 160 which is fluidly coupled to an exit port 154 of a displaced air line 150. The gas bladder stores the air which is displaced in the hollow interior by the soil sample. The gas bladder 160 is preferably evacuated prior to use. FIG. 8 illustrates shows the fluid entrance 106 for the sampling device 102 penetrating an interior surface 110 of the barrel 104. It is understood that any of the other embodiments disclosed herein may also optionally include a fluid entrance penetrating the interior surface.

A third embodiment of the invention is shown in FIGS. 9–13. A sampling device 202 includes a barrel 204 having a sample tube 228, a drive shoe 214 and an inner ring 262. Although the barrel is preferably formed in three parts it may also be formed in any number of parts. The sample tube 228 has first and second sections 231, 233 held together at a downhole end by the drive shoe 214 and inner ring 262 and at an uphole end by a valve assembly 240. A fluid entrance 206 penetrates the inner ring 262 and is used for collecting the fluid sample. Preferably a number of fluid entrances are provided circumferentially spaced around the barrel. As stated in the description of sampling device 2, the fluid entrance may take many forms but is preferably a circular hole having a diameter of about 0.06 inches.

Figure 9:
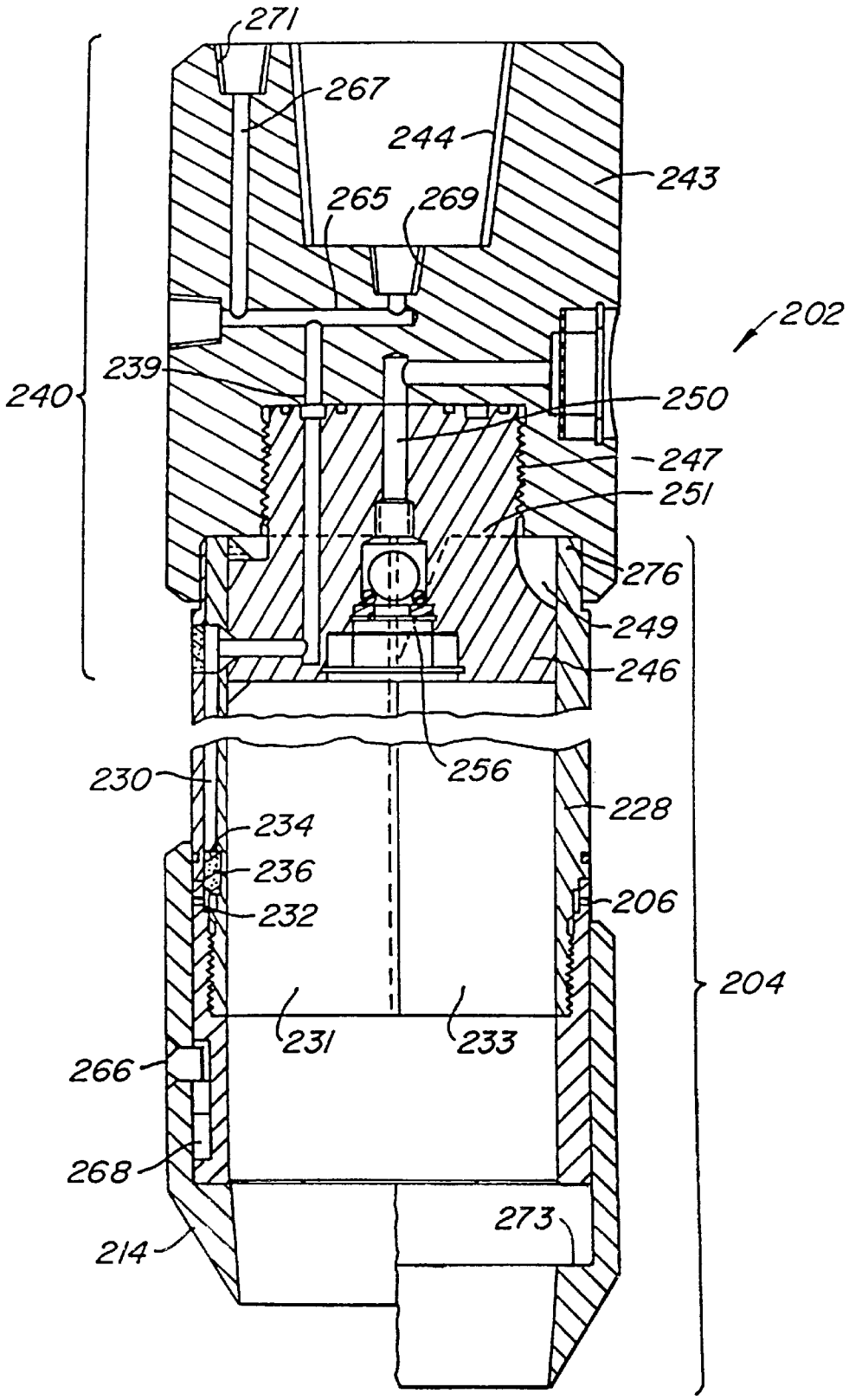
FIG. 9 is a cross-sectional view of a third embodiment of the soil and fluid sampling device with the drive shoe depicted in a first, retracted position, and a second, extended position.
Figure 10:
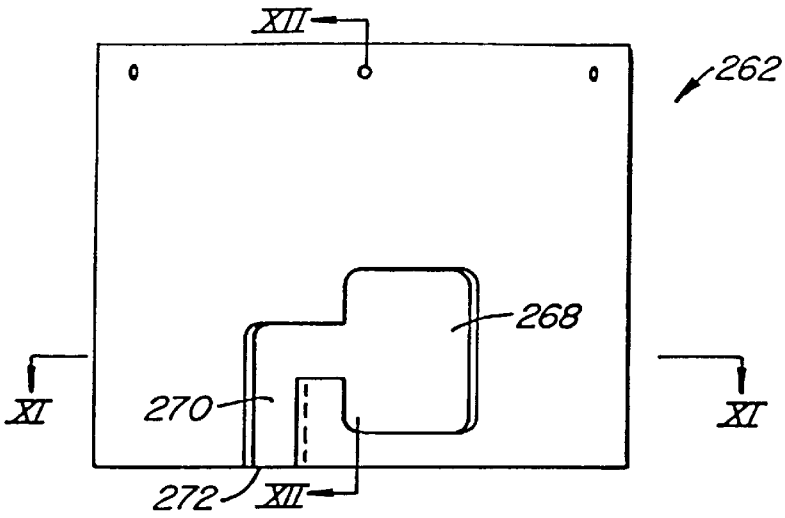
FIG. 10 is a side view of an inner ring.
Figure 11:
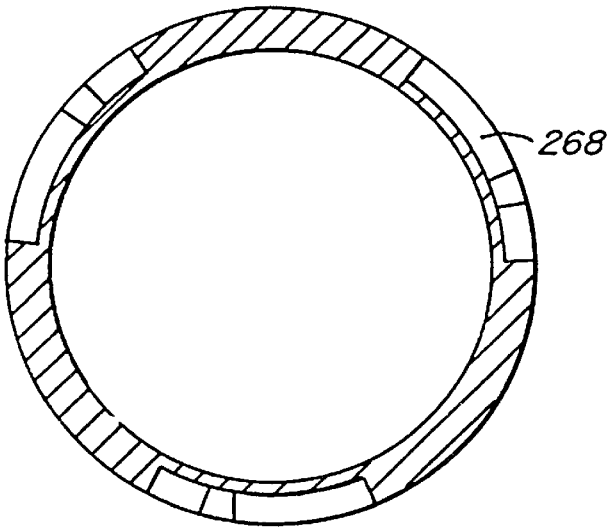
FIG. 11 is a cross-sectional view of the inner ring of FIG. 10 along line XI—XI.
Figure 12:
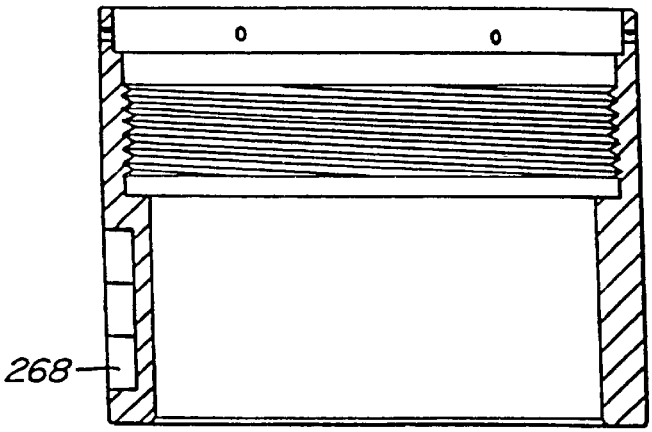
FIG. 12 is a cross-sectional view of the inner ring of FIG. 7 along line XII—XII.
Figure 13:
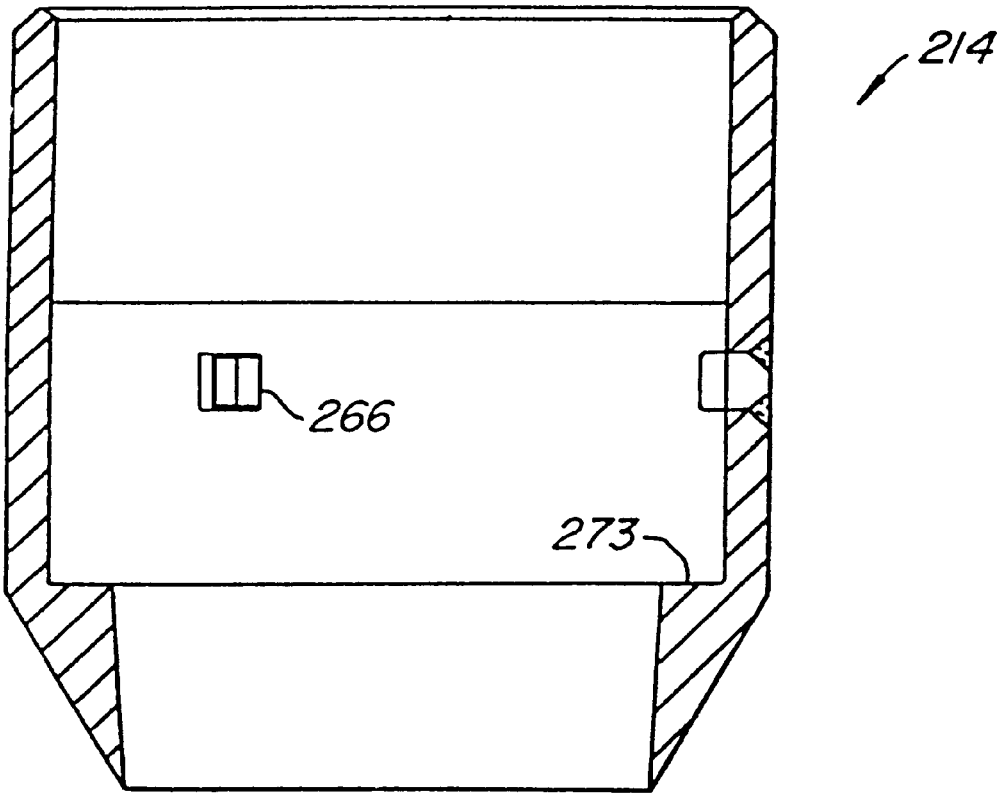
FIG. 13 is a cross-sectional view of the drive shoe for the third embodiment of the soil and fluid sampling device.

The drive shoe 214 is movably coupled to the inner ring 262 between a first position, in which the fluid entrance is covered, and a second position, in which the fluid entrance is exposed. FIG. 9 depicts the drive shoe 214 in both the first and second positions. The left hand side shows the drive shoe 214 in the first position while the right hand side shows the drive shoe 214 in the second position. As discussed below, the sampling device is lowered into the borehole and driven into the subsurface with the drive shoe in the first position to prevent cross-contamination of the fluid sample. The drive shoe is held in the first position by the o-ring. For additional assurance that the drive shoe will not move to the second position the elastic band 59 may also be positioned around the barrel covering part of the drive shoe and part of the sample tube 228.

The drive shoe 214 has pins 266 which engage pockets 268 in the inner ring 262. The pockets 268 include a slot 270 having an opening 272. The pin 266 is aligned with the opening 272 for installing and removing the drive shoe 214. When the drive shoe is in the first position a shoulder 273 of the drive shoe 214 contacts the inner ring 262 so that a longitudinal load on the drive shoe is transferred directly to the inner ring rather than to the pins 266. When the drive shoe 214 moves to the second position the pins 266 engage a bottom edge 270 of the pocket 268.

The sampling device 202 is lowered into the borehole with the drive shoe 214 in the first position. The sampling device 202 is then driven into the formation thereby forcing the soil sample into the hollow interior of the sampling device 202. The sampling device 202 is then pulled toward the uphole end. As the sampling device is pulled toward the uphole end the drive shoe frictionally engages the formation. The upward movement of the sampling device moves the drive shoe to the second position and exposes the fluid entrance 206. The fluid sample is then collected in the manner described below. The drive shoe 214 may be moved from the first position to the second position by many other methods. For example, the drive shoe may engage the inner ring with a screwed fitting whereby rotary motion of the barrel moves the drive shoe. The drive shoe may also be configured to move without requiring longitudinal movement of the sampling device 202. For example, the sampling device may include an uphole actuating mechanism for moving the drive shoe such as a wire, which can be pulled to move the drive shoe, a hydraulic line, or an electromechanical actuator.

The movable drive shoe 214 prevents fluid from entering the fluid entrance 206 until the sampling device is driven into the formation. Any other fluid flow preventing mechanism may also be used. For example, a sleeve may be provided which is movable independent of the drive shoe. The fluid flow preventing mechanism may also be a valve movable between the inner and outer surfaces at the fluid entrance 206. The fluid flow preventing mechanism may also be the elastic band 59 (FIG. 1).

The valve assembly 240 includes an outer body 243 and an inner body 246. The inner body 246 is welded to the first section 231 of the sample tube 228 and connected to the outer body at a threaded connection 247. The inner body 246 and first section 231 may also be formed together. The inner body 246 includes a semi-circumferential cut-out 249 which facilitates removal of the soil sample from the sampling device. After a soil sample is collected in the sampling device 202 the drive shoe 214 and inner ring 262 are removed so that the first and second sections 231, 233 of the sample tube 228 are no longer mechanically connected at the downhole end. The downhole end of the second section 233 is then rotated away from the soil sample with an upper edge 276 of the second section rotating into the cut-out 274. The second section 233 is then removed thereby exposing the soil sample. An upper end of the second section is wedge shaped, as depicted by broken line 251, so that the second section 233 can be rotated away from the first section. The valve assembly 240 also preferably includes a displaced air line 250 and a check valve 256 which operate in the same manner as air line 50 and check valve 56 described above.

The fluid entrance 206, which is preferably a plurality of fluid entrances, is positioned to penetrate the inner ring 262 of the barrel 204. An annular channel 232 is formed between the inner ring and the sample tube 228. The annular channel 232 is coupled to a longitudinal channel 230 extending from the downhole end of the sample tube to an outlet port 239. At the downhole end of the longitudinal channel 230 is a filter cavity 234 housing a filter 236. The filter 236 is preferably a fluid permeable membrane made by POREX®. The POREX® filter is preferably made of a porous plastic with an average mean pore size in the range of 10–150 microns with void volumes of 35–50%. The filter cavity 236 is slightly larger in cross-section than the longitudinal channel 230. A stainless steel tube (not shown) may be brazed into the longitudinal channel 230 to facilitate cleaning and resist corrosion.

The annular channel 232 and longitudinal channel 230 together define a fluid path 238. The fluid path 238 may take any form so long as it fluidly couples the fluid entrance 206 and the outlet port 239.

The outer body 243 includes a liquid sample path 265 and a gas sample path 267. The liquid sample path leads to a rod connection 244 which receives a rod used to drive the sampling device into the subsurface. The liquid and gas sample paths terminate at liquid and gas ports 269, 271. The port are adapted to receive a plug which seals the respective sample path.

The method of collecting fluid and soil samples of the present invention is described below in connection with the preferred embodiment of FIGS. 9–13. The method may, of course, be practiced using any device adapted to perform the steps as defined by the claims and is not limited to the specific embodiment described herein.

Figure 15:
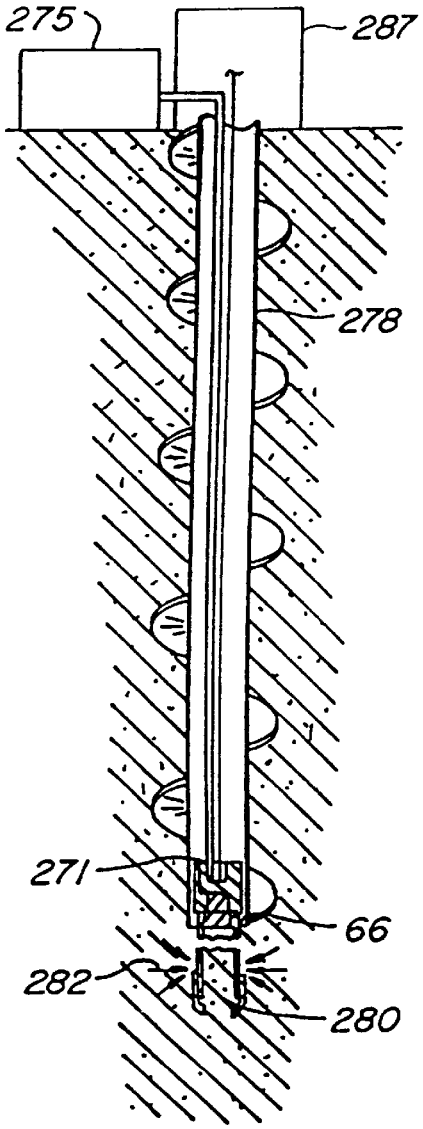
FIG. 15 shows the sampling device of FIGS. 9–13 driven into a subsurface for collecting a soil gas sample.

The sampling device 202 is decontaminated and configured in the desired sampling mode. If a soil gas sample is desired a vacuum pump 275 is coupled to the gas port 271 and a plug is inserted into the liquid port 269 (FIG. 15). The plug prevents prevent flow through the liquid port.

A borehole is drilled into the subsurface with a hollow stem auger 278 or any other drilling method. The hollow stem auger 278 advantageously minimizes cross-contamination in the borehole. If surface samples are desired a borehole is obviously not necessary. After the borehole is drilled to the desired depth the sampling device 202 is lowered into the hollow stem auger 278 to the bottom of the borehole.

The sampling device 202 is then driven into a terminal end 66 of the borehole with the drive shoe 214 in the first position. The sampling device is preferably driven into the subsurface with a wire line driven downhole hammer device 287 but may, of course, be driven into the subsurface by any other method. As the sampling device 202 is driven into the terminal end 66 a soil sample 280 is forced into the hollow interior 12.

After the sampling device 202 has been driven into the terminal end 66 of the borehole the sampling device is pulled toward the uphole end to move the drive shoe to the second position relative to the inner ring. Movement of the drive shoe exposes the fluid entrances 206. The vacuum pump 275 is then turned on to draw a soil gas sample into the fluid entrance 206 and through the fluid path 238. The soil gas flow into the fluid entrances 206 is depicted by arrows 282. After the soil gas sample has been collected the sampling device is recovered to obtain the soil sample.

If a liquid sample is desired the sampling device 202 is preferably configured as follows. A hollow rod 285 is inserted into the rod connection 244 and a plug is inserted into the gas port 271. The sampling device 202 is then driven into the subsurface by any conventional method and preferably by an uphole hammering device 286. The sampling device is pulled back toward the uphole end to move the drive shoe to the second position and expose the fluid entrances 206.

Figure 14:
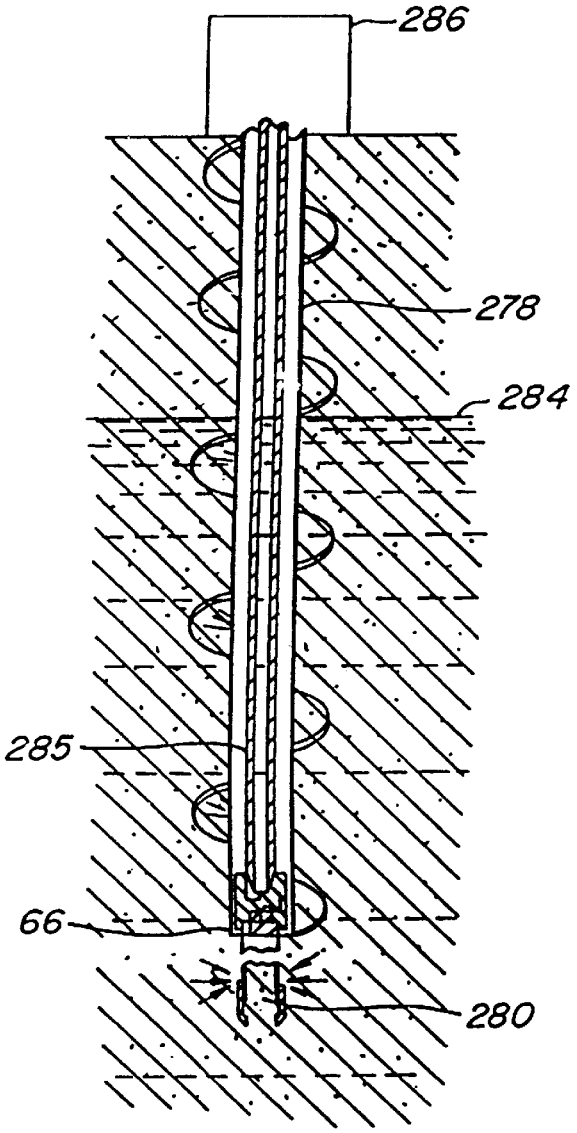
FIG. 14 shows the sampling device of FIGS. 9–13 driven into a subsurface for collecting a liquid sample.

Referring to FIG. 14, the liquid in the subsurface enters the fluid entrance and rises through the sampling device and into the hollow rod 285 under a potentiometric head 284 of the liquid in the formation (FIG. 14). A liquid collection device, such as a bailer, is lowered into the hollow rod 285 to obtain the liquid sample.

By collecting fluid and soil samples simultaneously, minimally disturbed samples are provided. In addition, the operating time required to collect both soil and fluid samples is decreased since only one downhole trip is necessary to collect fluid and soil samples.

A fourth sampling device 302 is shown in FIGS. 16–21. The sampling device 302 includes a sample barrel 304 having a drive shoe assembly 306 connected thereto at a downhole end 308. The sample barrel 304 includes an interior surface 307 and an exterior surface 309 defining a hollow interior 310 in which the soil sample is collected.

The sample barrel 304 includes a sample tube 312 which preferably has the same range of dimensions as the previously described embodiments. The sample tube 312 is preferably split longitudinally into first and second sections 314, 316 along split lines 318, one of which is shown in the cross-section of FIG. 16.

A core vent cover 320 is positioned between the first and second sections 314, 316 and seats against a sample tube head 322. The cover vent cover 320 has a groove 324 which receives an o-ring 326 engaging the interior surface 307 of the sample barrel 304. The cover vent cover 320 includes a displaced air passage 330 for air displaced by a soil sample entering the sample barrel 304.

The sample tube head 322 is preferably welded to the first section 316 of the sample tube 312. The sample tube head 322 includes a displaced air line 332 extending from an entrance port 334 to an exit port 336. The displaced air line 332 is coupled to the displaced air passage 330 of the core vent cover 320. A reed valve 338 is positioned along the displaced air line 332 which permits an air flow from the entrance port 334 to the exit port 336. A filter 340 covers the exit port 336 to prevent material from entering the displaced air line 332. The reed valve 338 is engaged by a nipple 342 of the core vent cover 320 to provide a substantially fluid tight seal therebetween. The reed valve 338 is essentially a one-way check valve and any other check valve may also be used without departing from the scope of the invention. The displaced air line 332 is provided for the reasons given above in connection with the previously described preferred embodiments.

A core sleeve 344, which is preferably formed by three separate six-inch cylindrical sections 345, fits within the sample barrel 304. The core sleeve 344 is known to those having skill in the art and is a conventional soil sampling tool. When the soil sample enters the sample barrel 304, the soil sample is received in the core sleeve 344. Since the core sleeve is generally composed of three separate six-inch sections 345, the connection 347 between each core sleeve provides a path through which fluid can escape from the soil sample.

In a further aspect of the present invention, the core sleeve 344 is completely encapsulated in a polyolefin shrink wrap 346 to help prevent pulling fluid from the soil sample during fluid sampling and also to limit off-gassing of the soil sample. The polyolefin shrink wrap also advantageously seals against the interior surface 307 along the split lines 318 to further reduce the likelihood of off-gasing of the soil sample. The top of the core sleeve 344 abutts against the o-ring 326 held by the core vent cover 320 to further prevent pulling fluid from the soil sample during fluid sampling. The shrink wrap 346 also provides a sanitary seal for the core sleeve 344 prior to sampling. The shrink wrap 346 is perforated adjacent the core vent cover 320 to permit passage of the displaced air from the sample barrel 304.

A circumferential fluid entrance 348 extends around the exterior surface of the barrel 304 for collecting the fluid sample. The fluid entrance 348 is formed by cutting a circumferential channel in the first and second sections 314, 316. The fluid entrance 348 may take any of the forms described above, however, the circumferential fluid entrance 348 is preferred since it advantageously admits fluid from all directions. The fluid entrance 348 is covered by a cylindrical screen 350. The screen 350 is preferably 50 mesh 321 stainless steel wire cloth having 0.009 inch wire diameter. The screen 350 is trapped between a shoulder 352 of the sample tube 312 and a screen retention collar 354 which is connected to the downhole end of the sample tube 312.

The fluid entrance 348 is fluidly coupled to two longitudinal channels 356 extending along the split lines 318 of the sample tube 312. The longitudinal channels 356 are formed by slots or grooves in the first and second sections 314, 316. Although it is preferred to provide two longitudinal channels 356, any number of channels may be provided. A removable polyethylene tube (not shown) is preferably positioned in each longitudinal channel 356 to facilitate cleaning. The polyethylene tubes preferably extend from the fluid entrance 348 to a recess 358 in the sample tube head 322. A preferred polyethylene tube has a 3/16 inch outer diameter and a 0.03 inch wall thickness. The polyethylene tubes preferably include fittings, as is known to those having skill in the art, at both ends to provide a substantially fluid tight engagement with the sample barrel 304 and the sample tube head 322.

Figure 16:
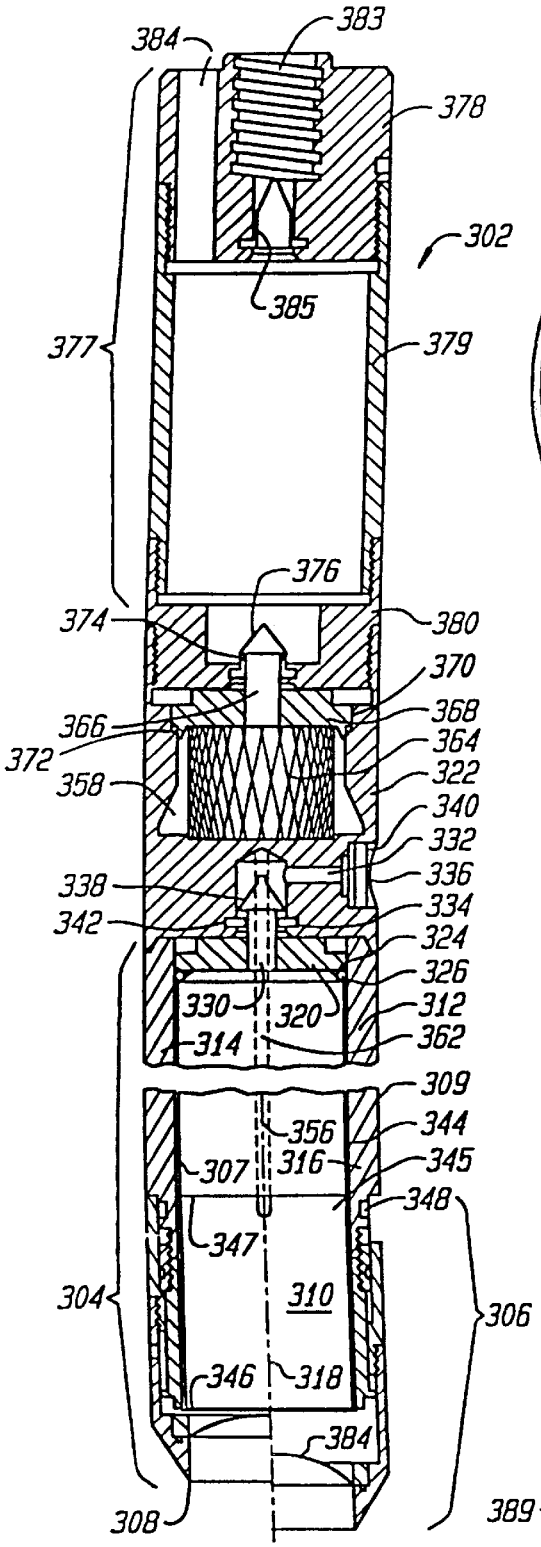
FIG. 16 is a cross-sectional view of a fourth sampling device.
Figure 17:
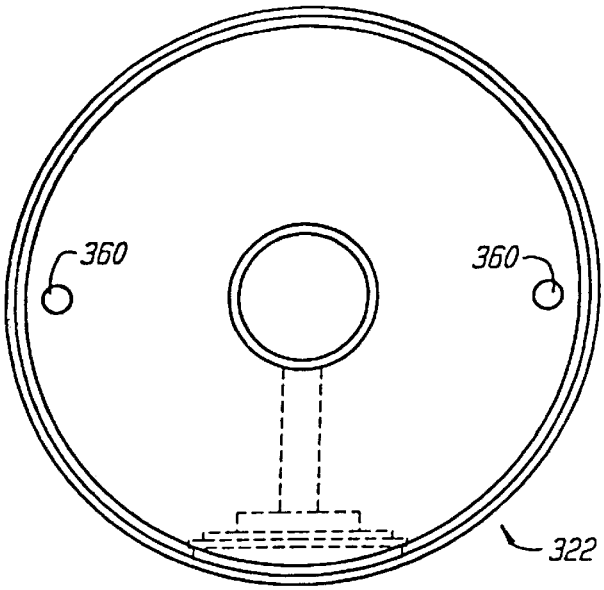
FIG. 17 is a bottom plan view of a valve body for the fourth sampling device of FIG. 16.

Referring to the plan view of FIG. 17, the sample tube head 322 includes two fluid passages 360 which are fluidly coupled to the longitudinal channels 356. Referring again to FIG. 16, the fluid passages 360 lead to the recess 358 formed in the sample tube head 322. A cylindrical filter 364 is positioned in the recess 358 to further filter the fluid flow. The filter 364 is preferably made of stainless steel. When collecting the fluid sample, the fluid flows into the recess 358 and radially inward through the cylindrical filter 364.

After passing through the cylindrical filter 364, the fluid flow passes through a centrally-located hole 366 in a cover 368 which encloses the uphole end of the sample tube head 322. The cover 368 is preferably the same as the core vent cover 320 to reduce manufacturing costs. Like the core vent cover 320, the cover 368 includes a groove 370 which receives an o-ring 372. The fluid passages 360, longitudinal channels 356, recess and hole 366 together define a fluid path 362. The fluid path 362 may also take any of the forms described above in the previously described preferred embodiments.

The fluid sample chamber 377 is enclosed by a fluid sampler head 378, a sidewall 379, and a fluid sampler bottom 380. The fluid sampler bottom 380 is threaded to the sample tube head 322. The fluid sampler bottom 380 includes a reed valve 376 which engages a nipple 374 of the cover 368. The reed valve 376 permits a fluid flow into the fluid sample chamber 377 and prevents fluid flow out of the fluid sample chamber 377.

The fluid sampler head 378 has a threaded connection 383 which receives a drive rod (not shown) for driving the sampling device 302 into the subsurface. The sampling device 302 may be driven into the subsurface using any of the methods described above or with any other method known to those having skill in the art. The fluid sampler head 378 includes a sensor port 384 and preferably at least three. The sensor port 384 is configured to receive various sensors for measuring various parameters such as pH, temperature, water level, specific conductance, dissolved oxygen, redox potential. Fiber optic sensors may also be used for analyzing organics in both gas and liquid phase as well as metals. During sampling, sensor ports 384 which are not used are plugged. The sensor ports 384 may also be used to collect the fluid sample by connecting a vacuum pump to the sensor port 384 when the fluid sample being retrieved is soil gas. A reed valve 385 is mounted to the fluid sampler head 378 and permits fluid flow out of the fluid sample chamber 377 through the threaded connection 383. The reed valve 385 may be used for discharging air displaced by fluid entering the fluid sample chamber 377. Alternatively, the displaced air in the fluid sample chamber 377 may be exhausted through a reed valve positioned in the sensor port 384. Yet another alternative is to provide an evacuated fluid sample chamber 377.

Although it is preferred to provide the fluid sample chamber 377, a hollow member may also be used in conjunction with a bailer to retrieve the fluid sample when the fluid sample desired is groundwater. The hollow member, which is preferably steel pipe, may be attached to either the fluid sampler head 378 or the sample tube head 322 for collecting the fluid sample.

Figure 18:
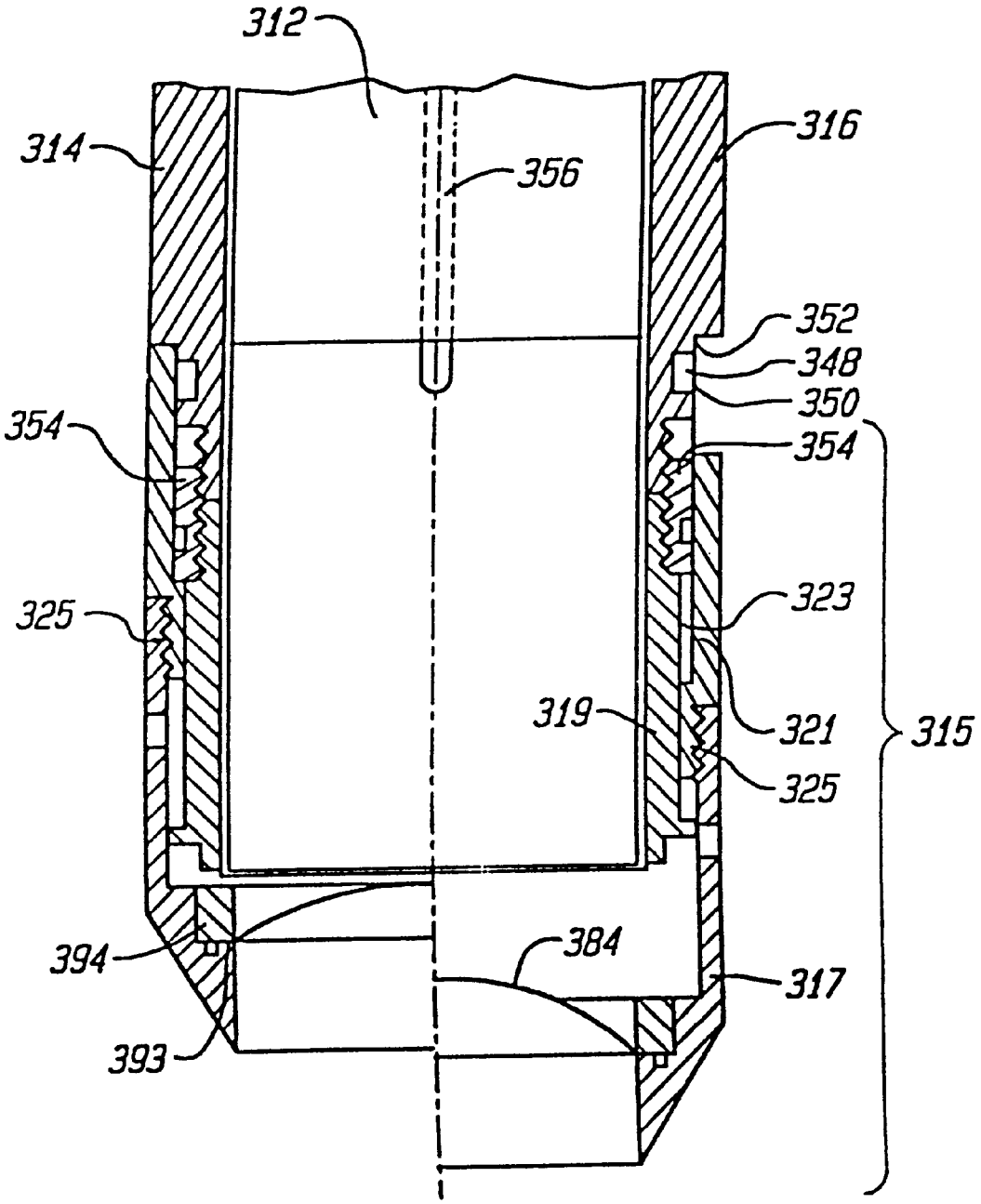
FIG. 18 is an enlarged view of the downhole end of the fourth sampling device of FIG. 16.

Referring now to FIG. 18, the drive shoe assembly 315 includes a drive shoe 317, an inner sleeve 319 and an outer sleeve 321. The inner sleeve 319 is connected, preferably by a threaded connection, to the screen retention collar 354 which together define a cylindrical recess 323. The drive shoe 315 and inner sleeve 319 are connected to one another and form a cylindrical ledge 325 which is positioned within the cylindrical recess 323. The ledge 325 and recess 323 limit movement of the drive shoe 317 between first and second positions as described below. The drive shoe 317 is preferably made of SAE 4140 steel and heat treated to Rc 38–40.

Referring again to FIG. 16, the drive shoe 315 and outer sleeve 321 are movable between a first position, in which the fluid entrance 348 is covered, and a second position, in which the fluid entrance 348 is exposed. The left-hand side of the drive shoe 317 in FIG. 16 shows the drive shoe 317 in the first position and the right-hand side shows the drive shoe 317 in the second position. The elastic band 59 (FIG. 1) may also be provided between the sample tube 312 and drive shoe assembly 315 to keep the drive shoe 317 in the first position when the sampling device 302 is lowered into the borehole or well.

A diaphragm 384 is preferably positioned adjacent an open end of the drive shoe 317 to prevent fluid and soil from entering the sample barrel 304 before the sampling device 302 is driven into the subsurface. Referring to the cross-sectional view of FIG. 19, the diaphragm 384 preferably includes a substantially circular perimeter 385, a central portion 386, and a lip 387. The lip 387 extends from the perimeter 385 and includes an annular portion 388 and a cylindrical portion 389. The cylindrical portion 389 is preferably continuous but may also include a number of individual tabs. The cylindrical portion 389 extends substantially parallel to a longitudinal axis 390 defined by the perimeter 385 and is preferably curved when viewed along a plane containing the longitudinal axis 390, however, the central portion 386 may also be flat or angled.

Figure 20:
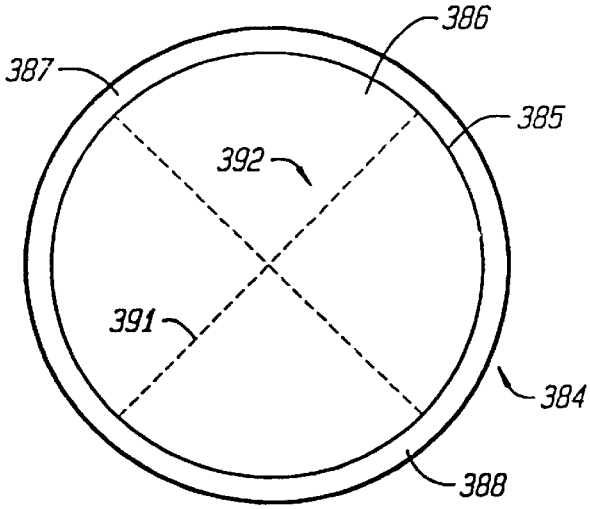
FIG. 20 is a plan view of the diaphragm of FIG. 19.
Figure 19:
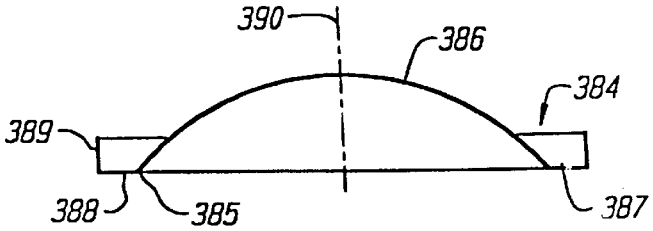
FIG. 19 is a cross-sectional view of a diaphragm.

Referring to the plan view of FIG. 20, the diaphragm 384 includes two radially-extending scores 391 which tear apart when the sampling device 302 is driven into the subsurface. When the diaphragm 384 is torn by the soil sample entering the barrel 304, four substantially triangular-shaped segments 392 are formed. The segments 392 advantageously help retain the soil sample in the interior of the sampling device 302 when the sampling device 302 is removed from the borehole. Although the radially-extending scores 391 are preferred, the diaphragm 384 may include other features which tear and, further, the features may be oriented in any other fashion. For example, the scores 391 may be circular, spiral or a number of parallel lines. Furthermore, the diaphragm may also be designed to tear into smaller pieces, rather than remain in one-piece, with the pieces being displaced into the barrel by the soil sample.

Referring again to FIG. 16, the diaphragm 384 rests against a lower ledge 393 of the drive shoe 317. The lip 387 receives a retainer 394 which holds the diaphragm 384 against the lower ledge 393 and provides tight engagement with the drive shoe 317. The lower ledge 393 has a groove 395 which receives an o-ring 396 to prevent fluid from passing around the diaphragm 384. A snap-ring may be provided (not shown) to help hold the diaphragm 384 in place, however, the snap-ring is not required.

The diaphragm 384 is preferably made of 38 gauge stainless steel but may also be made of any other suitable material. If the soil is relatively hard, the diaphragm 384 can be made of a rigid material without damaging or compressing the soil sample. The depth and length of the scores 391 can also be varied so that the force required to separate the segments is compatible with the type of formation being sampled. Furthermore, although it is preferred to provide a separate retainer 394, the retainer 394 and diaphragm 384 may also be formed as a single unit which is replaced after each sampling run. Finally, the diaphragm is preferably provided for all of the preferred embodiments described herein and, furthermore, may be used with any other type of soil sampling device to prevent cross-contamination of the soil sample.

Figure 21:
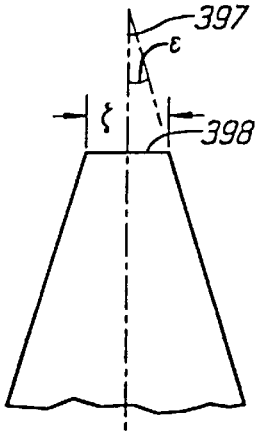
FIG. 21 shows a preferred thread arrangement for the fourth sampling device.

The various parts of the sampling device 302 which are threaded together preferably have stub Acme threads as shown in FIG. 21. The threads form an angle $\epsilon$ of 14.5 degrees with respect to a centerline 397 of the threads. A top 398 of the threads has a width $\xi$ of preferably 0.047".

Although the stub Acme threads are preferred, other thread arrangements may also be used with the sampling device 302.

The sampling device 302 is preferably cleaned and decontaminated before assembly so that sampling is not tainted. After being assembled, the sampling device 302 is then the operated in the manner described above in connection with the previously described preferred embodiments.

A fifth preferred sampling device 402 is shown in FIGS. 22–33. The sampling device 402 is adapted for use with the direct push method of sampling. A tip 403 is initially fixed to the remainder of the sampling device 402 for driving the sampling device to the desired sampling depth. At the desired sampling depth, the tip 403 is released and the sampling device 402 is then driven into the formation to admit the soil sample into the sampling device 402. Unlike the other sampling devices described above, a borehole is not required since the sampling device 402 may be driven directly into the subsurface to the desired sampling depth.

The sampling device 402 includes a barrel 404 having a drive shoe 406 mounted thereto at a downhole end 408. The barrel 404 has an exterior surface 410 and an interior surface 412 defining a hollow interior 414 in which the soil sample is collected. The barrel 404 includes first and second sections and 416, 418 a retention collar 420.

Figure 23:
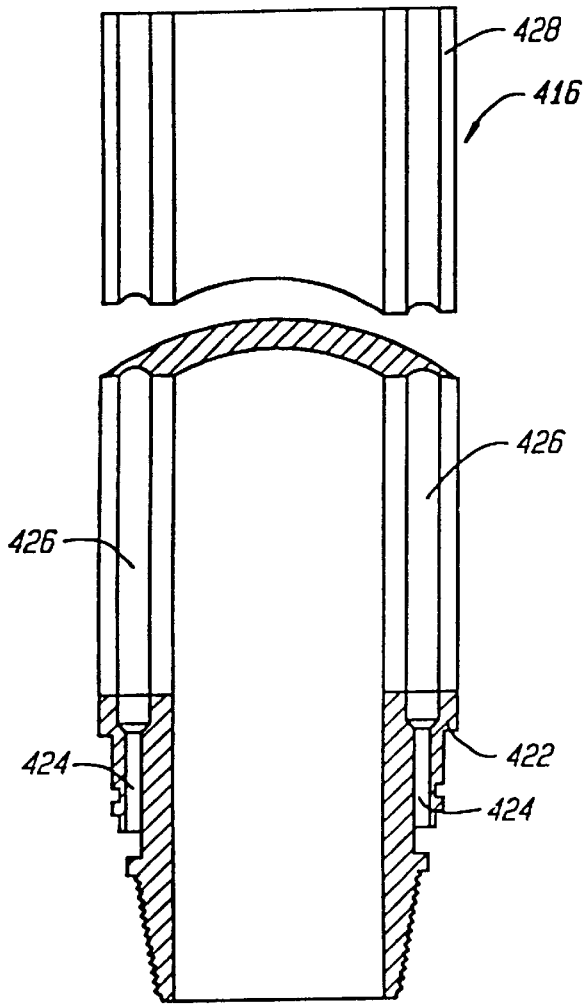
FIG. 23 is a cross-sectional view of a first section of a barrel for the fifth sampling device.
Figure 24:
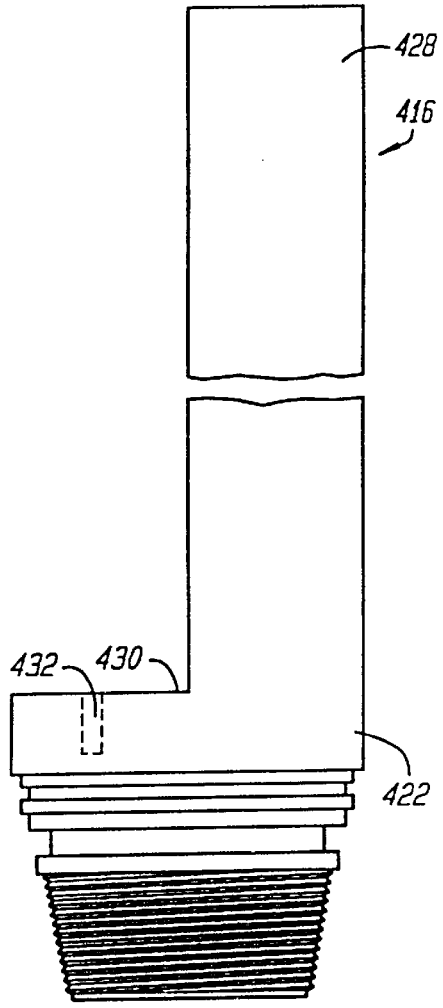
FIG. 24 is a side view of the first section of the barrel.
Figure 25:
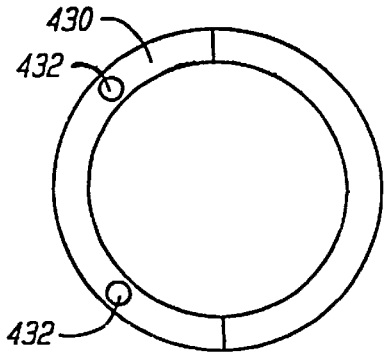
FIG. 25 is an end view of the first section of the barrel.

Referring to the cross-sectional view of FIG. 23, the first section 416 of the barrel 404 includes a lower portion 422 having holes 424 drilled therethrough. Longitudinal slots 426 are cut in an upper portion 428 of the first section 416 which are coupled to the holes 424. Referring to FIGS. 24 and 25, the first section 416 includes a bearing surface 430 having dowel pin holes 432 drilled therein. A dowel pin (not shown) is positioned in the dowel pin holes 432 for holding the first and second sections 416, 418 together.

Figure 26:
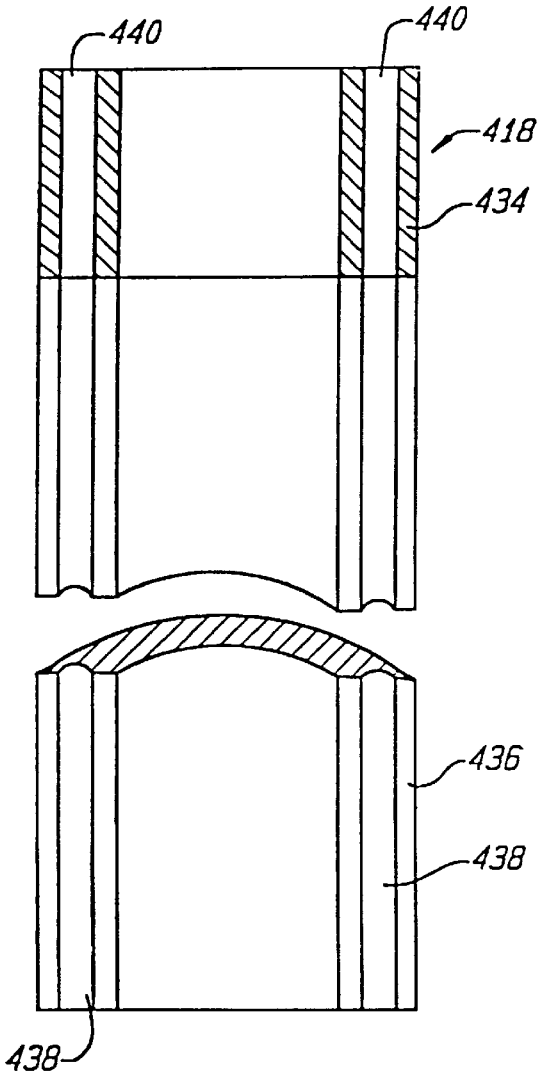
FIG. 26 is a cross-sectional view of a second section of the barrel.
Figure 27:
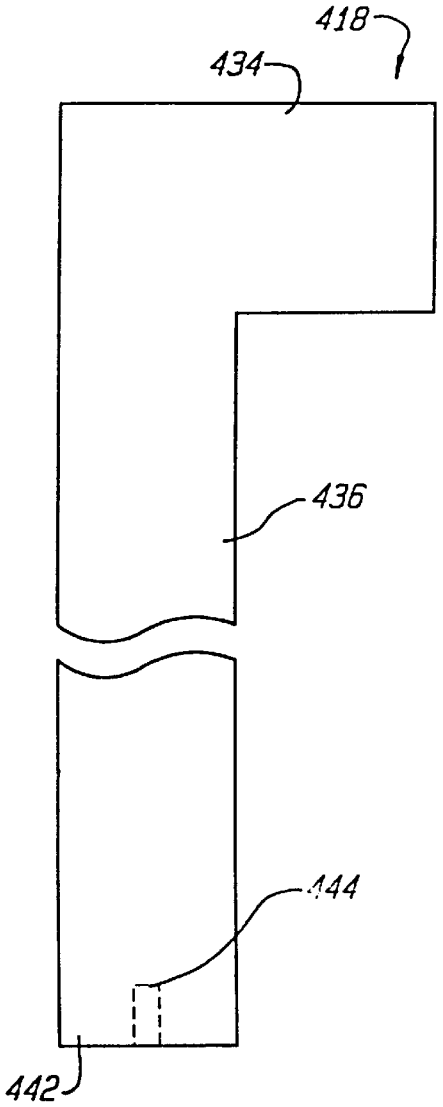
FIG. 27 is a side view of the second section of the barrel.
Figure 28:
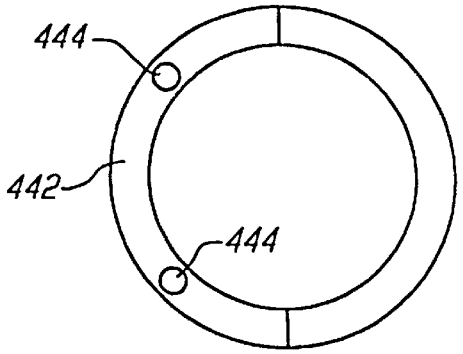
FIG. 28 is an end view of the second section of the barrel.

Referring to FIGS. 26 and 27, the second section 418 includes a substantially cylindrical upper portion 434 and a lower portion 436. The lower portion 436 is formed with slots 438 which engage the slots 426 in the first section 416. The upper portion 434 has holes 440 drilled therethrough which are coupled to the slots 438 in the lower portion 436. Referring to FIG. 28, the second section 418 also has a bearing surface 442 with dowel pin holes 444 drilled therein. The dowel pin (not shown) extends through the dowel pin holes 432, 444 in the first and second sections 416, 418. The sampling device 402 also preferably includes the encapsulated core sleeve (not shown) described above in connection with the sampling device 302.

Referring again to FIG. 22, a circumferential fluid entrance 446 extends around the exterior surface 410 of the barrel 404, however, the fluid entrance 446 may also take any of the forms described above. The fluid entrance 446 is covered by a cylindrical screen 448 which is preferably 50 mesh 321 stainless steel wire cloth having 0.009 inch wire diameter. The screen 448 is trapped between a shoulder 450 of the barrel 404 and the retention collar 420. The fluid entrance 446 is fluidly coupled to the holes 424 in the first section 416 of the barrel 404. The holes 424 and slots 426, 438 together define two longitudinal channels 452 extending from the fluid entrance 446. A removable polyethylene tube (not shown), as described above, is preferably positioned in each longitudinal channel 452 to facilitate cleaning. Although it is preferred to provide two longitudinal channels 452, any number of channels may be provided.

A barrel plug 454 seals an uphole end 469 of the barrel 404 and is preferably welded to the first section 416 of the barrel 404. The barrel plug 454 has a throughhole 456 in which is positioned a reed valve 458. The reed valve 458 permits a flow of air out of the barrel 404 but prevents air flow into the barrel 404. The barrel plug 454 has a displaced air line 460 which is provided for the reasons given above in connection with the sampling devices 2, 102, 202, 302. The uphole end of the barrel plug 454 is threaded to a drive coupling 462.

Figure 29:
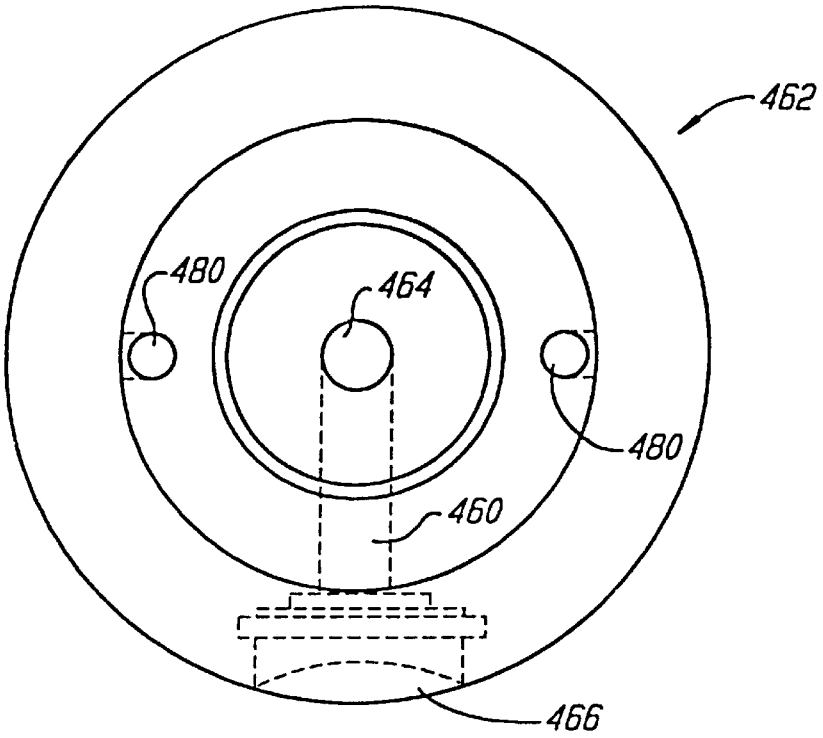
FIG. 29 is a plan view of a drive coupling for the fifth sampling device.

The drive coupling 462 has a passage 464 which is coupled to the throughhole 456 in the barrel plug 454. Referring to FIG. 29, the passage 464 is coupled to a displaced air exhaust port 466. A filter (not shown) is preferably positioned at the exhaust port 466 to prevent material from entering the displaced air line 460.

The drive coupling 462 has a threaded recess 468 which is configured to engage a hollow member (not shown), preferably a piece of pipe. The sampling device 402 is driven into the subsurface by applying a driving force to the hollow members in a manner known to those having skill in the art. As the sampling device 402 advances further into the subsurface, additional hollow members are added. The drive coupling 462 has a groove which receives an o-ring 472 to seal the connection between the drive coupling 462 and the barrel plug 454. The drive coupling 462 also includes a groove which receives an o-ring 476 to seal the connection between the drive coupling 462 and a spacer 478.

Figure 22:
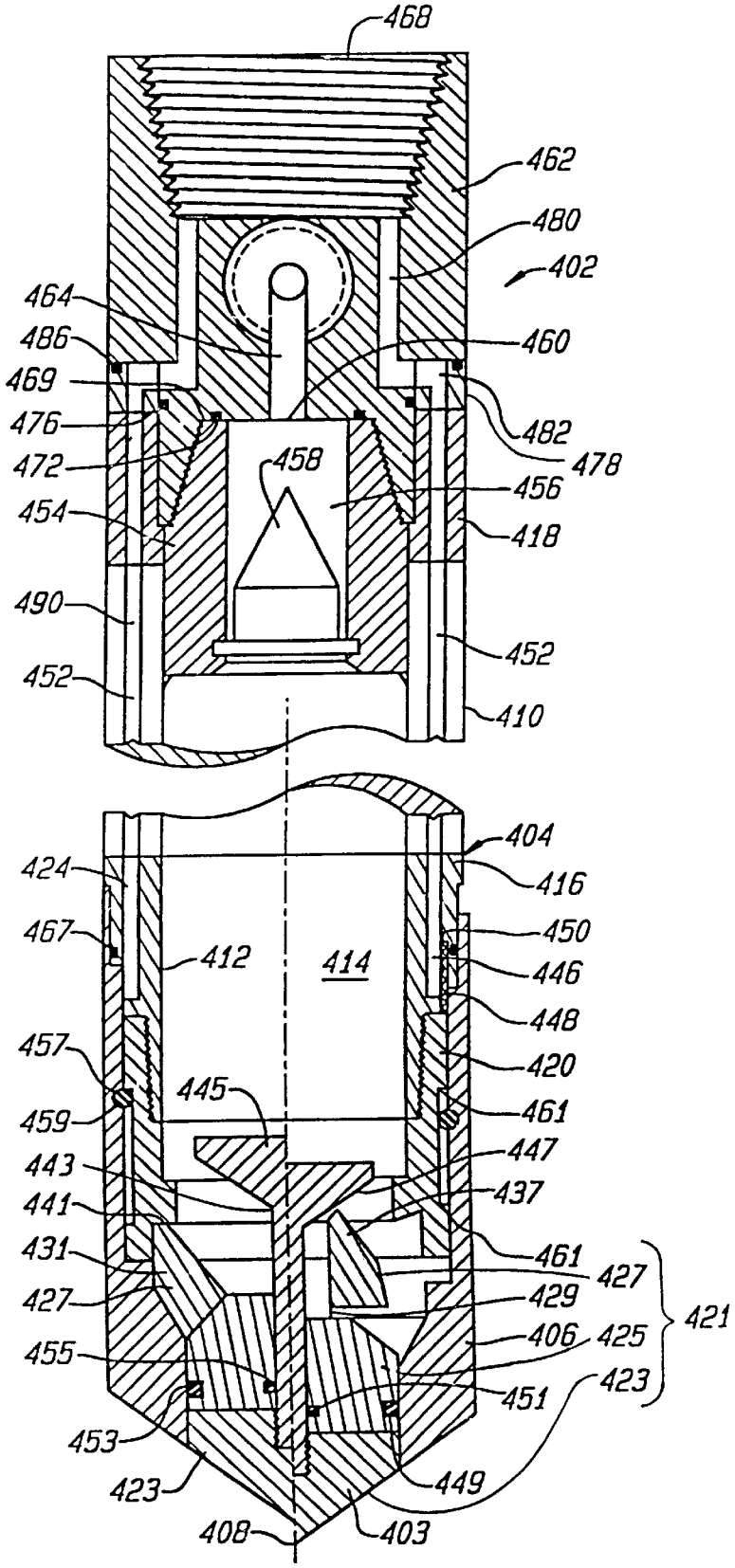
FIG. 22 is a cross-sectional view of a fifth sampling device.
Figure 30:
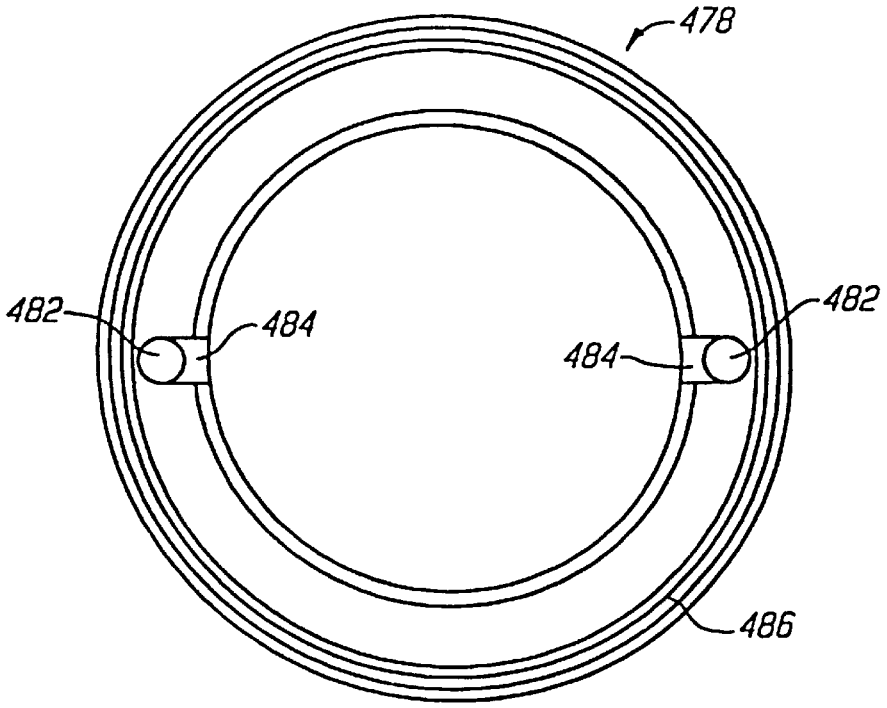
FIG. 30 is a plan view of a spacer for the fifth sampling device.
Figure 31:
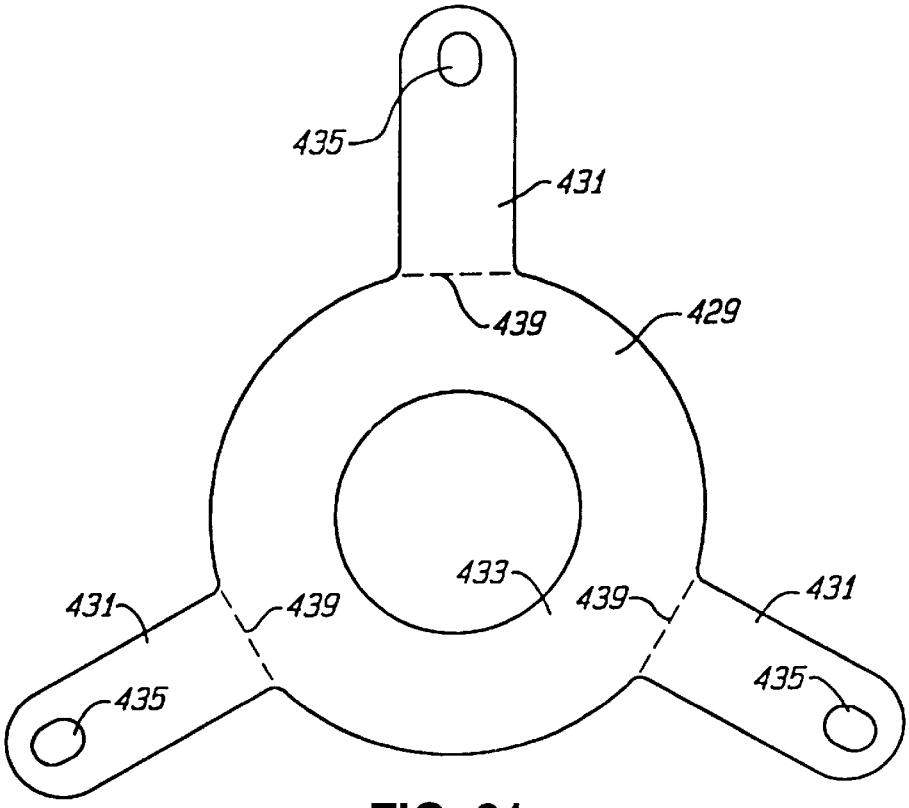
FIG. 31 is a plan view of a retractor for the fifth sampling device.

Referring to FIGS. 22 and 29, the drive coupling 462 has two channels 480 which extend toward the downhole end from the recess 468. The channels 480 are coupled to holes 482 in the spacer 478. Referring to FIG. 30, the spacer 478 has slots 484 cut radially inward from the holes 482 so that the holes 482 are in fluid communication with the channels 480 in the drive coupling 462. Referring again to FIG. 22, the spacer 478 also includes a groove 486 which receives an o-ring 488 to seal the connection between the drive coupling 462 and the spacer 478. The longitudinal channels 452, holes 482 and channels 480 together define a fluid path 490. The fluid path 490 and fluid entrance 446 may also take any of the forms described above.

The tip 421 includes a point 423, a base 425, and a releasing mechanism 427. The point 423 preferably includes a removable carbide tip (not shown) for facilitating penetration of the formation and to minimize wear of the point 423. The releasing mechanism 427 is movable between a locked position, in which the tip 421 is coupled to the barrel 404 for driving the sampling device 402 into the subsurface, and a released position, in which the tip 421 is displaceable toward the uphole end of the sampling device 402. The locked position is illustrated in the left-hand side of FIG. 22 and the released position is shown in the right-hand side of FIG. 22.

The releasing mechanism 427 includes a retractor 429 having three resilient arms 431. Referring to the plan view of FIG. 31, the arms 431 are integrally formed with a central portion 433. A preferred material for the retractor 429 is 22 Ga. spring steel. Each of the arms 431 has a throughhole 435 for attaching a contact 437 thereto with rivets (not shown). The arms 431 are folded along fold lines 439 to be perpendicular to the central portion 433 so that the natural, unbiased position of the arms is the released position shown in the left-hand side of FIG. 22.

The contacts 437 are preferably formed from a ring which is cut into three sections. The retractor 429 is preferably formed with three arms 431, however, any number of arms 431 may be provided. When the retractor 429 is in the locked position, as shown in the left-hand side of FIG. 22, the contacts 437 engage a stop 441 on the retention collar 420. In this manner, the tip 421 is drivingly coupled to the barrel 404 for driving the sampling device 402 into the subsurface. Although it is preferred to provide the arms 431 with separate contacts 437, the contacts 437 may be dispensed with and the arms 431 may contact the barrel 404 directly.

A point set 443 extends through the base 425 and has a threaded connection with the point 423. The point set 443 includes a head 445 having a frustoconical surface 447 facing the tip 421. The point set 443 is used for moving the releasing mechanism 427 to the locked position. During assembly of the sampling device 402, the point set 443 is pressed toward the downhole end so that the surface 447 engages the contacts 437 and forces the contacts 437 outward into the locked position.

The base 425 includes first and second o-ring grooves 449, 451 which receive first and second o-rings 453, 455. The first o-ring 453 seal a space between the tip 421 and the drive shoe 406 and the second o-ring 455 to seals a space between the tip 421 and the point set 443. The first o-ring provides a frictional engagement between the base 425 and the point set 443 so that the point set 443 does not slide toward the downhole end of the device. The second o-ring 455 provides frictional engagement between the tip 421 and the drive shoe 406 so that the tip 421 is not forced through the open end of the drive shoe 406 by the resilient forces of the retractor 429 when the releasing mechanism 427 is in the locked position.

Figure 32:
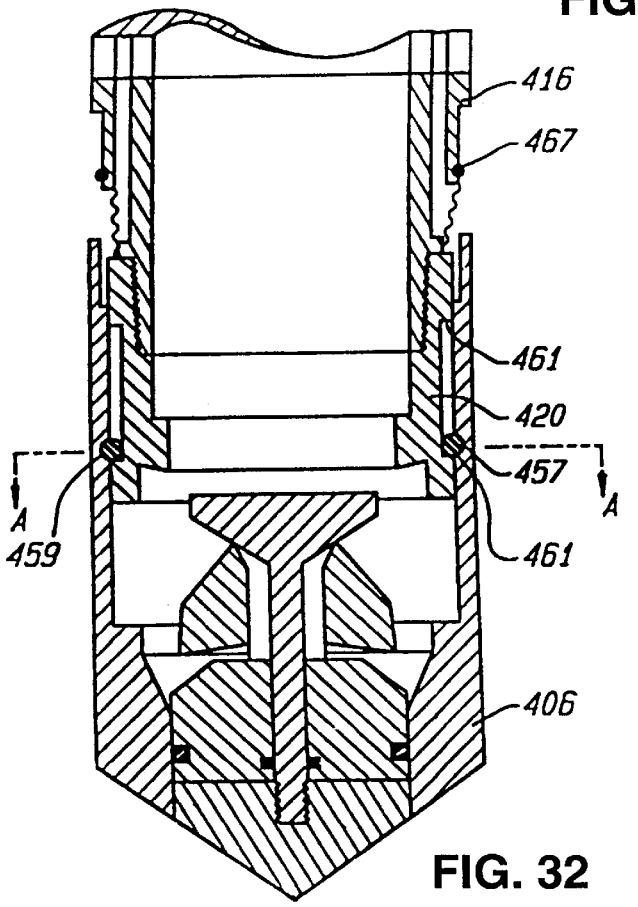
FIG. 32 shows a drive shoe of the fifth sampling device in a sampling position with a fluid entrance exposed for collecting a fluid sample.
Figure 33:
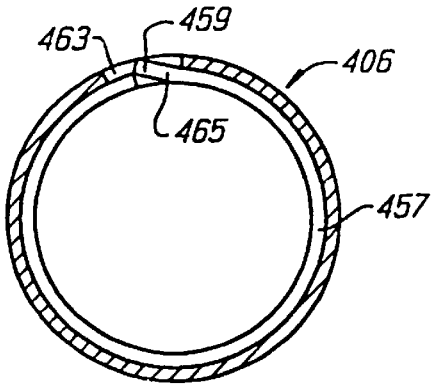
FIG. 33 is a cross-sectional view of the drive shoe of the fifth sampling device.

The drive shoe 406 is movable between three different positions; a driving position, in which the fluid entrance 446 is covered, a release position, in which the fluid entrance 446 is covered and the tip is released, and a sampling position, in which the fluid entrance 446 is exposed. The left-hand side of the drive shoe 406 in FIG. 22 depicts the drive shoe 406 in the driving position and the right-hand side depicts the drive shoe 406 in the release position. When the drive shoe 406 is in the release position, an o-ring 467 prevents fluid from entering the fluid entrance 446. Referring to FIG. 32, the drive shoe 406 is shown in the sampling position with the fluid entrance 446 exposed.

Referring again to FIG. 22, the drive shoe 406 preferably includes a groove 457 which receives a cord 459 preferably made of nylon. The cord 459, in conjunction with stops 461 on the retention collar 420, limits the movement of the drive shoe 406 between the driving and releasing positions. Referring to the cross-sectional view of the drive shoe 406 about line A—A, the drive shoe 406 includes an opening 463 communicating with the groove 457. When assembling the sampling device 402, the cord 459 is fed through the opening 463 and into the groove 457. The cord 459 is preferably sized a bit larger than the circumference of the groove 457 so that an overlapping portion 465 is provided around the opening 463 to make removing the cord 459 easier. By sizing the cord 459 in this manner, an end of the cord 459 is exposed for removing the cord 459 when disassembling the sampling device 402.

Use of the sampling device 402 is now described. The sampling device 402 is driven into the subsurface with the drive shoe 406 in the driving position and the retractors 429 in the first position so that the contacts 437 engage the stop 441 on the retention collar 420. The sampling device 402 is then driven into the subsurface to the desired sampling depth. Successive hollow members are added to the device to reach the desired sampling depth. The sampling device 402 is then pulled toward the uphole end to move the drive shoe 406 to the release position shown in the right-hand side of FIG. 22. The retractors 429 are biased inwardly to their natural, relaxed position and the contacts 437 are disengaged from the stop 441. The sampling device 402 is then driven into the subsurface so that a soil sample enters the barrel 404. As the soil sample enters the barrel 404, the tip 421 is displaced upwardly into the barrel 404 by the soil sample.

After the soil sample is in the barrel 404, the sampling device 402 is then pulled toward the uphole end so that the drive shoe 406 moves to the sampling position shown in FIG. 32 thereby exposing the fluid entrance 446. When the desired fluid sample is groundwater, the groundwater will rise through the fluid path 490 and into the recess 468. A bailer (not shown) is then lowered into the hollow members attached to the drive coupling to retrieve a groundwater sample as is known to one having skill in the art. After the groundwater sample has been retrieved, the sampling device is removed from the subsurface to retrieve the soil sample.

Although it is preferred to provide the fluid entrance 446 and fluid path 490, the sampling device 402 may also be configured for retrieving only the soil sample and the fluid entrance 446 and fluid path 490 may be dispensed with. Furthermore, the sampling device 402 may be provided with the fluid sample chamber 377 of the sampling device 302 by attaching the fluid sample chamber 377 to the threaded recess 468.

Modification and variation can be made to the disclosed embodiments without departing from the subject of the invention as defined by the following claims. For example, the exterior surface may be rectangular or irregularly shaped, the fluid entrance may be positioned at the uphole end rather than the downhole end, the flow path may be formed by an annular space between two concentric tubes, and any of the sampling devices may be provided with the tip 421 rather than simply the fifth sampling device 402. Furthermore, the scope of the invention as it pertains to environmental sampling is developed only as an example of one particular use for the invention. The method and apparatus of the present invention may, of course, be used to obtain samples for any other purpose such as oil, gas and geothermal exploration.

What is claimed is:

1. An environmental sampling device, comprising:

a barrel including a downhole end, an interior surface defining a hollow interior configured to receive a soil sample, and an open end at the downhole end of the hollow interior;

a drive cone assembly including a tip and an engaging member, the engaging member having a first, laterally extended, position in which it is engaged with the barrel to drivingly couple the drive cone assembly to the barrel, and a second retracted position in which the drive cone assembly is displaceable from the open end of the barrel, the engaging member releasable from the first to the second position in response to relative longitudinal movement between the barrel and the drive cone assembly.

2. The environmental sampling device of claim 1 wherein the engaging member includes at least one arm and a spring member biasing the arm into a retracted condition, the arm being laterally extended against the bias of the spring member when the engaging member is in the first position, and the arm being retracted from the barrel by the spring member when the engaging member moves from the first position to the second position.

3. The environmental sampling device of claim 2 wherein the arm is resiliently coupled to the drive cone assembly by the spring member.

4. The environmental sampling device of claim 1, wherein the engaging member has an inward spring bias, the engaging member being inwardly displaceable by its inward spring bias when the releasing mechanism moves from the first position to the second position.

5. An environmental sampling device, comprising:

a barrel including a downhole end, an interior surface defining a hollow interior configured to receive a soil sample, and an open end at the downhole end of the hollow interior;

a drive cone assembly including a tip and a releasing mechanism the releasing mechanism having a first position and a second position, the drive cone assembly being drivingly coupled to the barrel and covering the open end of the barrel when the releasing mechanism is in the first position, the tip and drive cone assembly being displaceable from the open end when the releasing mechanism is in the second position;

the releasing mechanism including an engaging member resiliently carried by the drive cone assembly, the engaging member drivingly coupled to the barrel when the releasing mechanism is in the first position, the engaging portion springing to a natural, retracted, position to when the releasing mechanism is in the second position a drive shoe slidably coupled to the barrel, the drive shoe moveable between a driving position and a releasing position, the drive cone assembly operatively coupled to the drive shoe so that the releasing mechanism is in the first position while the drive shoe is in the driving position, the releasing mechanism moving to the second position when the drive shoe moves from the driving position to the releasing position.

6. A method for collecting an environmental sample comprising the steps of:

(a) providing a barrel including a downhole end, a hollow interior configured to receive a soil sample, an open end at a downhole end of the hollow interior, and further providing a drive cone assembly having a tip and an engaging member carried by the drive cone assembly, the tip having a first position in which the engaging member is drivingly coupled to the barrel and the tip covers the open end of the barrel, and a second position in which the engaging member springs to a retracted position and the tip is displaceable from the open end;

(b) with the engaging member drivingly coupled to the barrel, driving the downhole end into a subsurface;

(c) altering the relative longitudinal positions of the barrel and drive cone assembly, causing the engaging member to spring from the first position to the second position; and (d) after step (c), driving the downhole end further into the subsurface so that a soil sample of the subsurface is forced through the open end and into the hollow interior.

7. The method of claim 6 wherein step (c) includes pulling the sampling device toward an uphole end so that the drive cone assembly slides relative to the barrel to release the engaging member to the second position.

8. A method for collecting an environmental sample comprising the steps of:

(a) providing a barrel including a downhole end, a hollow interior configured to receive a soil sample, an open end at a downhole end of the hollow interior, and further providing a drive cone assembly having a tip and an engaging member carried by the drive cone assembly, the tip having a first position in which the engaging portion is drivingly coupled to the barrel and the tip covers the open end of the barrel, and a second position in which the engaging portion springs to a retracted position and the tip is displaceable from the open end and further providing a drive shoe slidably coupled to the barrel, the drive shoe being operatively coupled to the drive cone assembly and being moveable between a driving position and a releasing position;

(b) with the engaging portion drivingly coupled to the barrel, driving the downhole end of the sampling device into a subsurface;

(c) causing the drive shoe to move from the driving position to the releasing position to release the engaging member from the first position to the second position, causing the engaging portion to spring from the first position to the second position; and (d) after step (c), driving the downhole end of the sampling device further into the subsurface so that a soil sample of the subsurface is forced through the open end and into the hollow interior.

9. The method of claim 8 wherein step (c) includes the step of pulling the sampling device toward an uphole end so that the drive shoe moves from the driving position to the releasing position.

* * * * *